United States Patent [19]

Shimokura et al.

[11] Patent Number: 4,911,787

[45] Date of Patent: Mar. 27, 1990

[54] METHOD FOR CONCENTRATING BLACK LIQUOR WITH OXIDIZING FOLLOWED BY $CO_2$ ADDITION

[75] Inventors: Akira Shimokura; Keiji Hasegawa; Shuichi Nagato; Kazushige Tanae, all of Kanagawa; Tokiya Yaguchi, Tokyo, all of Japan

[73] Assignee: Research Association of Pulp and Paper Technology, Tokyo, Japan

[21] Appl. No.: 99,037

[22] Filed: Sep. 21, 1987

Related U.S. Application Data

[63] Continuation-in-part of Ser. No. 778,636, Sep. 20, 1985, abandoned, and Ser. No. 905,414, Sep. 10, 1986, abandoned.

[30] Foreign Application Priority Data

Aug. 9, 1985 [JP] Japan ..... 60-175497

[51] Int. Cl.[4] ..... D21C 11/10

[52] U.S. Cl. ..... 162/30.11; 162/30.1; 162/31; 423/DIG. 3; 159/47.3

[58] Field of Search ..... 162/16, 29, 30.1, 30.11, 162/31; 159/47.3; 423/DIG. 3, 207; 530/500, 507

[56] References Cited

U.S. PATENT DOCUMENTS

| | | | |
|---|---|---|---|
| 3,299,942 | 1/1967 | Jacoby | 159/47.3 |
| 3,525,666 | 8/1970 | Brannland | 162/30.11 |
| 3,549,314 | 12/1970 | Shah | 162/30.11 |
| 3,635,790 | 1/1972 | Heath | 159/47.3 |
| 3,714,911 | 7/1973 | Pradt | 162/30.11 |
| 4,239,589 | 12/1986 | Elton et al. | 159/47.3 |
| 4,331,507 | 5/1982 | Roberts | 162/29 |
| 4,504,356 | 3/1985 | Mulder et al. | 162/32 |

*Primary Examiner*—Karen M. Hastings

*Attorney, Agent, or Firm*—Armstrong, Nikaido, Marmelstein, Kubovcik & Murray

[57] ABSTRACT

A method and apparatus are disclosed for concentrating an alkaline waste liquor containing sulfur compounds, the so-called black liquor, which is discharged from a step of Kraft-cooking wood fibers, in order to recover the cooking chemicals from said waste liquor, characterized in that $CO_2$ gas and/or a gas containing $CO_2$ gas is added to said waste liquor as a boiling-point-lowering agent, viscosity-lowering agent and solidification promoter, after a step of oxidizing said waste liquor and in or prior to one or more stages during the step of concentrating said waste liquor. Also disclosed is an apparatus for concentrating an alkaline waste liquor containing substantially no sulfur compounds (i.e., an AP black liquor), comprising (1) a primary concentrator for concentrating the AP black liquor discharged from said cooking means and washing means, (2) a secondary concentrator for further concentrating the AP black liquor concentrated in said primary concentrator and (3) exhaust gas absorbing means disposed between said primary and secondary concentrators.

3 Claims, 30 Drawing Sheets

METHOD FOR CONCENTRATING BLACK LIQUOR WITH OXIDIZING FOLLOWED BY $CO_2$ ADDITION

BACKGROUND OF THE INVENTION:

This is a continuation-in-part application of U.S. application Ser. No. 778,636 filed on Sept. 20, 1985, now abandoned and 905,414 filed Sept. 10, 1986, now abandoned.

The present invention is directed to an improved method and apparatus for concentrating alkaline waste liquor in the production of wood pulp. In one aspect of the invention, the alkaline waste liquor containing sulfur compounds discharged from a Kraft (or "KP") cooking process of wood fiber (hereafter referred to as "KP black liquor") is concentrated and the liquor cooking chemicals are recovered. In a second aspect of the invention, the alkaline waste liquor containing substantially no sulfur compounds discharged from an AP cooking process of wood fiber (hereafter referred to as "AP black liquor") are concentrated.

In the production of wood pulp, particularly of chemical pulp, the KP process which uses sodium hydroxide and sodium sulfide as major cooking chemicals has been the main process, in view of the high quality of the pulp produced and the known advantages of this cooking chemicals recovery system.

The step of concentrating the KP black liquor is a very important step before the recovery boiler which recovers the chemicals and the heat energy produced by the combustion of organic materials contained in the KP black liquor.

The KP black liquor discharged from the KP process normally has a very low concentration of 10–20%. It is necessary to concentrate the KP black liquor to a concentration of greater than about 50%, normally 60–70%, because a high concentration of the KP black liquor is effective in the recovery and re-use of the heat energy produced by the combustion.

When a ton of pulp is produced, 1.5–2 tons of KP black liquor solids are normally discharged. In order to concentrate the black liquor 15–50%, 9–12 tons of water per ton of pulp must be evaporated from the KP black liquor. A great deal of evaporation energy is needed in order to evaporate this water from the KP black liquor. Thus, the step of concentrating the KP black liquor involves a multiple-effect evaporator wherein steam which has been used once in the concentration of the KP black liquor is re-used in another evaporator.

However, it is known that as the concentration of the KP black liquor increases, its vapor pressure drops and its boiling point increases sharply. Accordingly, the highly concentrated KP black liquor is further concentrated by adding a large amount of heat energy thereto, so that its vapor pressure is increased and its temperature thereof rises to its boiling point.

A significant step leading to the present invention is the discovery of the fact that an addition of $CO_2$ gas to the KP black liquor reduces its boiling point and its viscosity, makes it easier to solidify, and improves its ability to be concentrated.

The technique of adding $CO_2$ gas to KP black liquor has been utilized in the prior art only for specific purposes such as the separation of lignin or silica. If $CO_2$ gas is added to KP black liquor, it becomes acidic by absorbing the $CO_2$ gas, and generates toxic hydrogen sulfide which has a bad smell. The hydrogen sulfide also presents corrosion problems for the apparatus. Thus, no attempt has been made to accomplish the purpose of the present invention.

The prior techniques for enhancing the ability of KP black liquor to be concentrated are as follows:

(A) increasing the area of the heating surface of the evaporator;

(B) increasing the heat conductivity of the heating surface of the evaporator;

(C) increasing the temperature of the KP black liquor; and (D) reducing the viscosity of the KP black liquor.

When the area of the heating surface is increased, the amount of evaporated black liquor also increases. This requires an enlargement of the size of the apparatus for concentrating the black liquor. Such enlargement does not reduce energy costs, but does lead to an increase in the cost of the apparatus.

When the heat conductivity of the heating surface of the evaporator is increased, the heat transfer speed on the surface increases, thereby increasing the rate of concentration. In practice, it is necessary to contact the KP black liquor directly with the metal surfaces of the heating surface and prevent the attachment of scale to the heating surface which would reduce the heat conductivity of the heating surface. Specifically, the heat conductivity has been recovered by removing the silica or alumina which causes the scaling by washing with dilute KP black liquor, warm water, or acidic water. A possible method of this type is to change the shape of the heating surface so that scale is less likely to deposit on the surface. The purpose of such a method is to maintain the initial heat conductivity rather than to positively enhance the ability of the KP black liquor to be concentrated.

When the temperature of the KP black liquor is increased, its vapor pressure naturally increases, but a great deal of evaporation energy is required to increase this pressure, and this method does not improve energy use.

The improvement in the ability of the KP black liquor to be concentrated by reducing its viscosity is known in the art. See, for example, "Kraft Pulp and Non-wood Fiber Pulp" in the Complete Technical Book of Production of Pulp and Paper (volume 3, page 145) edition by The Japanese Technical Association of the Pulp and Paper Industry. The method incorporated herein by reference is directed to the use of a low concentration of KP black liquor to increase the temperature of the KP black liquor, or the addition of a surface active agent to the KP black liquor to reduce the viscosity of the black liquor.

A method of adding such a surface active agent to the KP black liquor as a viscosity-reducing agent is disclosed in the Japanese Laid-Open Pat. Publication No. 228094/84. According to that method, the viscosity is reduced by only $\frac{1}{2}$–$\frac{1}{3}$, compared to the KP black liquor to which no surface active agent is added. This method offers no advantage in the reduction of the boiling point or in making solidification easier.

Japanese Pat. Application No. 47876/85 discloses a method of adding an acidic material, or a material which exhibits acidity when dissolved in water, to a soda-cooked black liquor. A remarkable reduction in viscosity can be obtained by this method but it is not applicable to KP black liquor because its viscosity is only slightly reduced.

U.S. Pat. No. 2,997,466 and Tappi 62 (11), 108 (1979) refer to the separation of lignin.

The increase in the concentration of the black liquor is accomplished by a substantial rise in the boiling point of the black liquor. As a result, the ability of the black liquor to be concentrated is reduced, and a large amount of heat energy is needed to concentrate further the black liquor. The purpose of one aspect of the present invention is to solve this problem.

As stated above, a second aspect of the present invention is to concentrate an AP black liquor, i.e., an alkaline waste liquor containing substantially no sulfur compounds. It has been confirmed by recent research that a soda substantially using sodium hydroxide as a main cooking chemical gives almost the same level of yield and quality of pulp as are obtained in the KP process. Moreover, in this process, no sulfur compound such as sodium sulfide is used as a cooking chemical, and therefore the process produces chemical pulp without generating a sour smelling substance during the cooking process as is the case with the KP process.

As a method of recovering chemicals in the AP process, it is possible to employ a direct causticization method in which the AP black liquor is blended with iron oxide and subjected combustion to produce sodium ferrite, which is then hydrolyzed to recover the sodium hydroxide as the cooking chemical. Although this method cannot be used in the KP process which involves a sulfur compound, it is known to be advantageous in terms of energy efficiency and its process is simplified in comparison with the causticization method employed in the KP process.

However, the viscosity of the AP black liquor is very much higher than that of the alkaline waste liquor of the KP process when both liquors are at the same concentration. The higher the concentration, the greater the difference in viscosity. As shown in FIG. 25, the viscosity of the AP black liquor is about ten times higher than that of the KP black liquor at a concentration of 70%.

High viscosity of the black liquor indicates that its fluidity has deteriorated and that the concentration efficiency of the black liquor in an evaporator is lowered. High viscosity also lowers the efficiency of transporting the black liquor into a combustion furnace and deteriorates sprayability from a burner in the furnace, so that the combustibility of the black liquor will be lowered.

As for conventional methods for lowering the viscosity of black liquor, the following are known to the art:

(A) lowering the concentration of the black liquor;

(B) raising the temperature of the black liquor;

(C) adding a surfactant to the black liquor, et.

However, if the AP black liquor is concentrated by using the same apparatus as the prior concentrating apparatus of the KP black liquor, it is unavoidably necessary to carry out combustion in a black liquor concentration of 60% which is 5–10% lower than that with the KP black liquor (65–70%).

The decrease which occurs in the black liquor concentration subjected to combustion indicates an increase in the amount of water to be evaporated in the combustion furnace, so that energy cannot be effectively used as heat energy.

Raising the temperature of the black liquor requires the addition of more heat.

And as mentioned above in the context of KP black liquor, Japanese Laid-Open Pat. Publication No. 22804/84 discloses a method of adding a surfactant to the black liquor. But the viscosity is lowered by only $\frac{1}{2}$–$\frac{1}{3}$ in comparison with the viscosity of the untreated black liquor and it is thus difficult to reduce the viscosity to the same level as that of the KP black liquor.

The object of this second aspect of the present invention is to solve the problems stemming from the fact that certain alkaline waste liquor, in particular AP black liquor, contains substantially no sulfur compounds and has a viscosity which is ten times higher than that of the KP black liquor, with a consequent deterioration in the fluidity of the black liquor, a lowering of the concentration efficiency, a decrease in transport efficiency, deterioration in sprayability, and a lowering of availability of heat energy for combustion caused by the decrease of the concentration of the black liquor in order to maintain a certain level of viscosity and the like.

This second aspect of the invention which relates to the treatment of AP black liquor differs from the first aspect of the invention which relates to the treatment of KP black liquor in that it is unnecessary to oxidize an AP black liquor containing substantially no sulfur compounds. Further, unlike Japanese Pat. Application Nos. 60-47876 and 60-118636 (corresponding to U.S. Pat. Appln. Ser. No. 765,093, filed Aug. 13, 1985 and since abandoned), there is no need to add pure $CO_2$ as a substance capable of improving the ability of the AP black liquor to be concentrated. Although the first aspect of the present invention and the above patent application relate to a method in which $CO_2$ is added to a black liquor in each concentration step, applicants have found that when an absorbing means using AP black liquor combustion exhaust gas is employed, it is more advantageous to absorb the exhaust gas into an AP black liquor having a black liquor concentration of 40–65% than into an AP black liquor having a black liquor concentration higher or lower than said range when taking into consideration the fact that the black liquor concentration of 40–65% enables a reduction in the amount of the black liquor to be treated, the need to avoid foaming of the black liquor in a case where the concentration of the AP black liquor is low, and the absorption of the exhaust gas into the black liquor and the difficulty in absorbing exhaust gas into the black liquor in a case where the concentration of AP black liquor is high. In addition, the above-described U.S. patent application discloses an apparatus in which the pH of the black liquor into which $CO_2$ gas has been absorbed is measured in the circulation line to control the amount of black liquor to be delivered in accordance with the measured pH value. Although this method allows control of the pH of the AP black liquor, it has been found that such method disadvantageously involves variations in the amount of $CO_2$ gas-absorbing black liquor supplied to the black liquor concentrating means. The second aspect of the present invention therefore overcomes this disadvantage and proposes an improved apparatus in which the amount of AP black liquor to be introduced into the exhaust gas-absorbing means is controlled by measuring the pH of a portion of the black liquor in the exhaust gas-absorbing black liquor storage tank. It has been confirmed that this novel approach allows the amount of black liquor supplied to the secondary black liquor concentrator to be stabilized by such pH control of the storage tank and consequently permits the operation of the secondary black liquor concentrator to be even more stabilized.

This second aspect of the present invention, which has been completed as a result of the research on the method of lowering the viscosity of the black liquor, is based on the discovery that the viscosity of the AP black liquor lowers to the same level as or less than that of the KP black liquor, when $CO_2$ gas contained in the AP black liquor combustion exhaust gas is absorbed into the AP black liquor. Thus, the property of the AP black liquor to be concentrated is improved.

SUMMARY OF THE INVENTION

The first aspect of the present invention involves a method and an apparatus for concentrating an alkaline waste liquor containing sulfur compounds, the so-called KP black liquor, which is discharged from a step of Kraft-cooking wood fibers, in order to recover the cooking chemicals from said waste liquor, characterized in that $CO_2$ gas and/or a gas containing $CO_2$ gas is added to said waste liquor as a boiling-point-lowering agent, viscosity-lowering agent and solidification promoter, after a step of oxidizing said waste liquor and in or prior to one or more stages during the step of concentrating said waste liquor.

The second aspect of the present invention is directed to a black liquor concentrating apparatus for concentrating AP alkaline waste liquor in a system for producing wood pulp by treating wood chips with alkaline chemicals containing substantially no sulfur compounds, said apparatus comprising:

(a) means for cooking wood chips at high temperatures and under high pressure together with alkaline chemicals containing substantially no sulfur compounds;

(b) washing means for separating wood pulp from an alkaline waste liquor, said wood pulp having been produced in said cooking means, and for washing as well as dewatering said wood pulp;

(c) multi-effect black liquor concentrating means for concentrating the alkaline waste liquor (i.e., a so-called AP black liquor) discharged from said cooking means and washing means;

(d) burning and recovering means for burning the black liquor concentrated by said black concentrating means together with iron oxide, and recovering burning reaction products consisting essentially of sodium ferrite, together with heat energy; and (e) causticizing means for hydrolyzing and separating the burning reaction products recovered by said burning and recovering means into cooking chemicals and iron oxide, wherein said black liquor concentrating means comprises (1) a primary concentrator for concentrating the AP black liquor discharged form said cooking means and washing means to the range between 40 and 65% by weight of the solids content, and (2) a secondary concentrator for further concentrating the AP black liquor concentrated in said primary concentrator to the range between 65 and 85% by weight of the solids content, and for supplying the concentrated AP black liquor to said burning and recovering means, wherein exhaust gas absorbing means is disposed between said primary and secondary concentrators, said exhaust gas absorbing means having an exhaust gas inlet and outlet, said exhaust gas inlet being adapted to introduce the AP black liquor combustion exhaust gas discharged from said burning and recovering means such as to absorb the $CO_2$ gas contained in said exhaust gas into said AP black liquor by directly contacting said exhaust gas with the AP black liquor, wherein said exhaust gas absorbing means has a storage tank disposed before said secondary concentrator, said storage tank having an inlet for introducing the black liquor from said exhaust gas absorbing means thereinto, and a supply pipe for supplying the black liquor to said secondary concentrator, wherein said exhaust gas absorbing means has a liquid level controlling means and pH controlling means for controlling the pH of the AP black liquor in the storage tank at a predetermined range thereby controlling the amount of AP black liquor and the exhaust gas to be introduced and wherein a vapor-liquid separator is disposed on the downstream side of said gas outlet of said exhaust gas absorbing means, the downstream side of said vapor-liquid separator being connected to a smokestack.

The AP black liquor may be a black liquor which contains an alkaline waste liquor and which is discharged from the cooking means and the bleaching means for bleaching the pulp, which has been washed by said washing means, with alkaline chemicals containing substantially no sulfur compounds.

The multi-effect black liquor concentrating means may treat the alkaline waste liquor discharged from either the cooking means or the washing means.

DETAILED DESCRIPTION OF THE INVENTION

Figure 1:
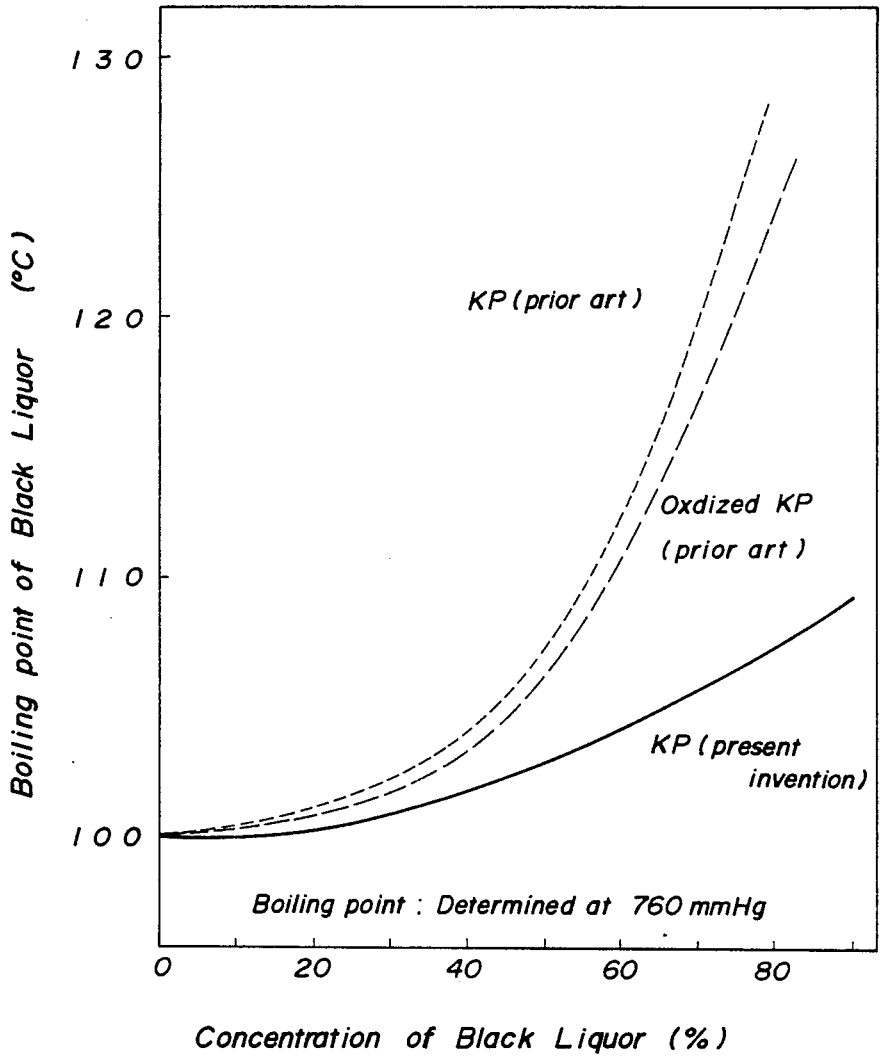
FIG. 1 is a graph illustrating the variations in the boiling point of the black liquor with the corresponding concentration thereof.

The KP black liquor of the first aspect of the present invention has a sulfidity of 1–100%, normally 5–35%. This liquor may contain Kraft-cooked black liquor of a low sulfidity, or an Alkafide-cooked black liquor.

This liquor may contain black liquor discharged from a step of cooking wood fibers using sodium hydroxide and sodium sulfide as main cooking chemicals together with anthraquinone, derivatives thereof, anthracene derivatives, aliphatic or aromatic amines, or aliphatic alcohols, either solely or in combination, as a cooking aid.

If $CO_2$ gas is added to KP black liquor which has just been discharged from a wood fiber cooking step, the pH of this liquor is reduced and hydrogen sulfide is generated by the reaction of the sulfur compounds therein and the CO gas. It is necessary according to the present invention to oxidize the KP black liquor before the addition of $CO_2$ gas to the liquor, so as to prevent the generation of toxic hydrogen sulfide gases which create bad smells and corrode the apparatus. Such oxidation of the KP black liquor has generally been carried out in the art for the purpose of preventing bad smells and increasing the sulfur recovery efficiency. However, the prior art does not provide the improved method of the present invention for efficiently concentrating black liquor, which comprises the addition of $CO_2$ gas to the black liquor as a boiling-point-reducing agent, viscosity-reducing agent, and solidification promoter of the black liquor, after the step of oxidizing the black liquor.

There is a negative method of contacting a $CO_2$-containing gas with KP black liquor in a cascade evaporator, but this method is not often used currently. This method comprises contacting the exhaust gas from the recovery boiler with the concentrated black liquor which has just been treated by the concentrating apparatus, to further concentrate the black liquor, whereby the heat energy contained in the exhaust gas is efficiently utilized. This method may negatively imply a partial contact and reaction between the KP black liquor and the $CO_2$ gas contained in the exhaust gas of the recovery boiler, because the gas inevitably contains $CO_2$ gas generated by the combustion of the organic materials in the black liquor. However, it is in no way intended that a positive reaction of the KP black liquor with the $CO_2$ gas contained in the exhaust gas occurs, but that such contact is controlled by maintaining the pH at 13.0–12.5 so that the generation of hydrogen sulfide by the reaction with $CO_2$ gas can be avoided. Thus, this method is not often available in paper mills because of the generation of hydrogen sulfide.

The step of adding $CO_2$ gas according to the present invention comes after the black liquor oxidation step subsequent to the KP-cooking step. However, even if the addition is carried out simultaneously with the oxidation, a similar effect can be obtained. Therefore, the present invention is not limited to the claimed method. However, in this case it is necessary to have the black liquor react with oxygen in preference to the $CO_2$ gas. This preferential reaction is put into practice by making the concentration of $O_2$ gas in the mixture of $O_2$ and $CO_2$ gases greater than that of the $CO_2$ gas. However, the system of adding $CO_2$ gas to the black liquor after the oxidation step is recommended from the standpoint of preventing the generation of hydrogen sulfide.

The oxidation degree of the black liquor according to the present invention is preferably 70–100%, more preferably 90–100%. A higher oxidation degree is desirable from the standpoint of preventing the generation of hydrogen sulfide and improving the ability of the black liquor to be concentrated.

An oxidation degree of 70–100% is attainable by using a prior-art oxidation step. Paper mills adopting the present invention may need not only the prior-art air oxidation step, but also another oxidation processing conducted by a gas containing a high concentration of $O_2$ such as adsorption, membrane separation, or low-temperature processing. Moreover, not only the prior-art oxidation of dilute black liquor but also the $O_2$-oxidation of concentrated black liquor may be needed.

According to the first aspect of the present invention, when $CO_2$ gas is added to the black liquor, an improvement in its ability to be concentrated is expected within a pH range of 9.5–12–5, preferably 10.0–12–0. The pH is determined at a concentration of 40% and a temperature of 80° C.; and, unless otherwise specified, the pH determined hereafter depends on this condition.

When the pH of the black liquor is more than 12.5, the reduction in its boiling point is not sufficient to concentrate the liquor. On the other hand, when the pH of the liquor is less than 9.5, its viscosity is increased, and this makes its ability to be concentrated worse.

Reducing the pH of the liquor to an excessively low level means an addition of excess $CO_2$ gas. A long time is necessary for this addition, and the excess gas is removed from the liquor by evaporation in the concentration step.

The range of the concentration of the black liquor to which $CO_2$ gas is added is not specifically limited. At whatever stage the $CO_2$ gas is added, the ability to be concentrated is improved after that addition. However, the higher concentration of the liquor to which the $CO_2$ gas is added, the less the amount of liquor to be treated. When $CO_2$ gas is added to liquor of an excessively high concentration, its viscosity is increased. Thus, the addition of $CO_2$ gas to the liquor becomes less efficient owing to the poor capacity of the liquor to absorb $CO_2$ gas. The lower the concentration of the black liquor to which the $CO_2$ gas is added, the more the amount of liquor which can be treated. However, the capacity of the liquor to absorb $CO_2$ gas is increased by its low viscosity. When $CO_2$ gas is added to oxidized black liquor, the concentration of the liquor is normally 20–75%, preferably 40–65%.

The temperature at which the $CO_2$ gas is added to the black liquor is not also particularly limited. Normally, the lower the temperature of the black liquor, the greater the absorption velocity of the gas by the liquid. However, the viscosity of the black liquor is higher at low temperatures, and the diffusion velocity of the $CO_2$ gas into the black liquor is reduced. On the other hand, the higher the temperature, the lower the absorption velocity. However, the viscosity of the black liquor is lower at high temperatures and the diffusion velocity of the $CO_2$ gas is increased. Methods conducted with the temperature of the black liquor high or low have their merits and demerits. Selection of one of the two methods is left to the pulp mills adopting the present invention. The temperature of the oxidized black liquor to which $CO_2$ gas is added may be 20°-100° C., preferably 40°-90° C. The use of the present invention is limited to wood fibers, but is also applicable to non-wood fibers.

The boiling point of the oxidized KP black liquor is greatly reduced by adding $CO_2$ gas to the liquor. As shown in FIG. 1, the boiling point is reduced by 18° C. from 126° C. (untreated black liquor) to 108° C. (black liquor with $CO_2$ gas added) at atmospheric pressure and a concentration of 80%.

Figure 2:
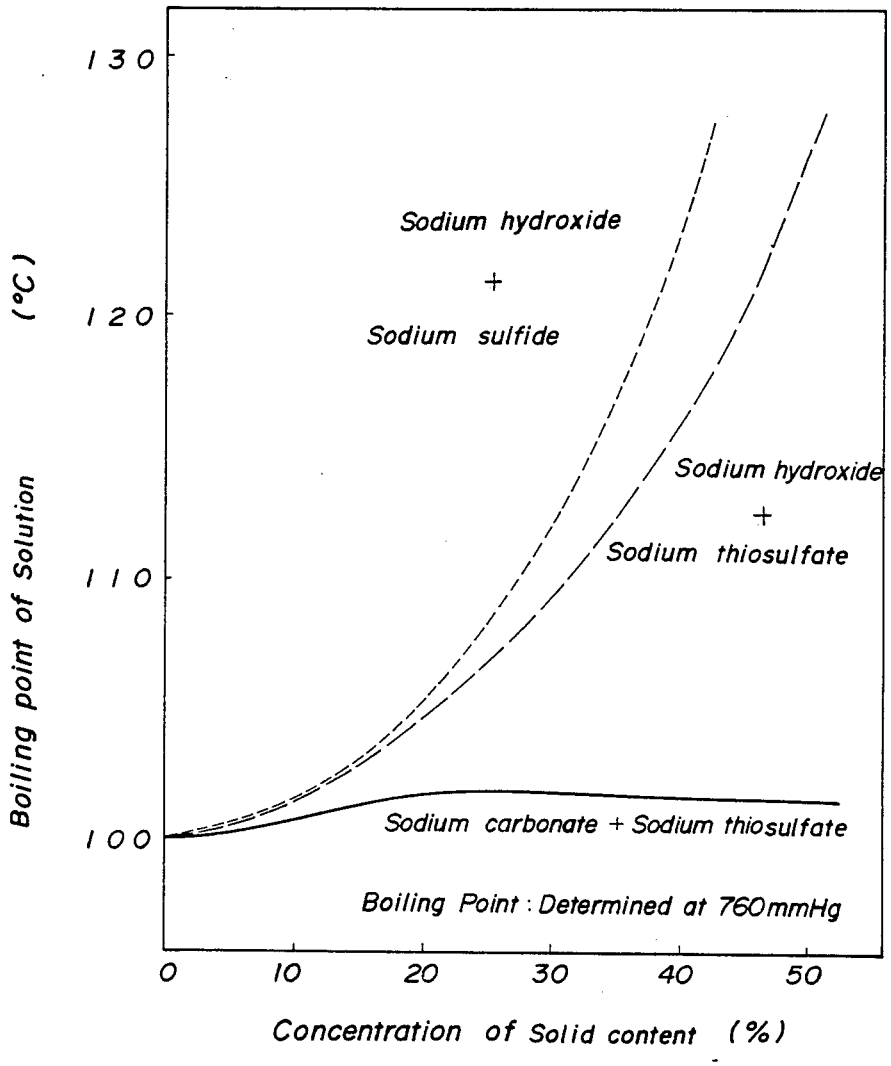
FIG. 2 is a graph illustrating the variations in the boiling point of the KP cooking chemicals with the corresponding concentration thereof.

FIG. 2 is a graph of boiling point versus the concentration of solid content, for (1) an aqueous solution of a mixture of sodium hydroxide and sodium sulfide, which is used in KP cooking, (2) an aqueous solution of mixture of sodium hydroxide and sodium thiosulfate which is obtained by oxidizing the mixture of (1), and (3) an aqueous solution of a mixture of sodium carbonate and sodium thiosulfate which is obtained by adding CO2 gas to the mixture of (2). As can be seen from FIG. 2, the boiling point of mixture (3) is much lower than those of mixtures (2) and (1). This is the reason why the boiling point of the black liquor is reduced by the addition of $CO_2$ gas.

Figure 4:
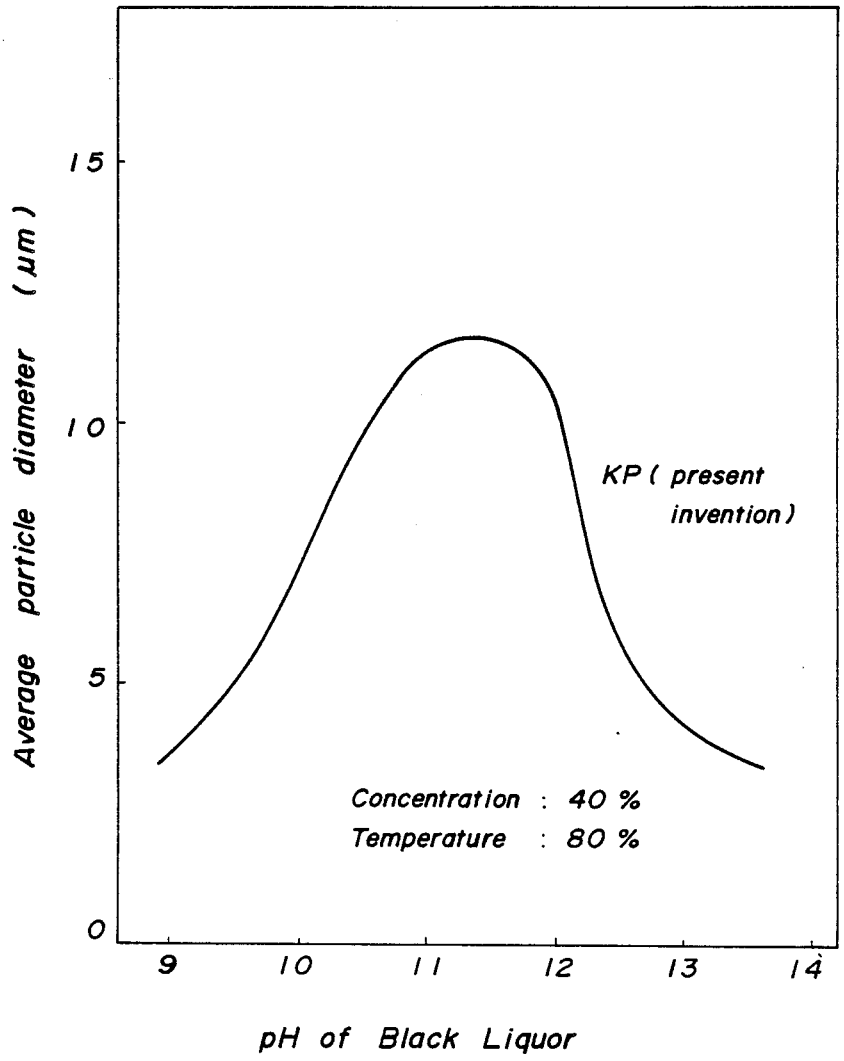
FIG. 4 is a graph illustrating the variations in the average particle diameter of the black liquor with the corresponding pH thereof.

As shown in FIG. 2, when $CO_2$ gas is added to oxidized KP black liquor, the viscosity thereof is reduced so that it is less than that of oxidized black liquor which has not been treated with $CO_2$ gas, in concentrations of greater than about 67%. Part of the lignin in the black liquor agglomerates and is dispersed therein by the reduction of the pH of the black liquor, as finely-divided particles. Thus a high-molecular aqueous solution of the lignin is though to be changed to an emulsion thereof. This is why the viscosity of the oxidized KP black liquor with added $CO_2$ gas is reduced by more than that of oxidized KP black liquor to which no $CO_2$ gas is added. FIG. 4 shows variations in the average particle diameter of the oxidized KP black liquor with added $CO_2$ gas, together with the corresponding pH thereof. Solid particles of such a diameter are acted on by the Brownian motion in the liquid and are efficiently dispersed therein. Accordingly, it is assumed that, in oxidized KP black liquor with added $CO_2$ gas, the part of the lignin which has agglomerated is sufficient to form an emulsion.

As can be seen from FIG. 4, when the pH of the black liquor is reduced, the average particle diameter of the agglomerated lignin becomes small. In general, the smaller the diameter of particles in an emulsion, the higher its viscosity. It can be easily understood from FIG. 5 that the viscosity of the oxidized KP black liquor with added $CO_2$ gas is increased at a pH of less than 9.5, because of the viscosity properties of the emulsion.

Figure 6:
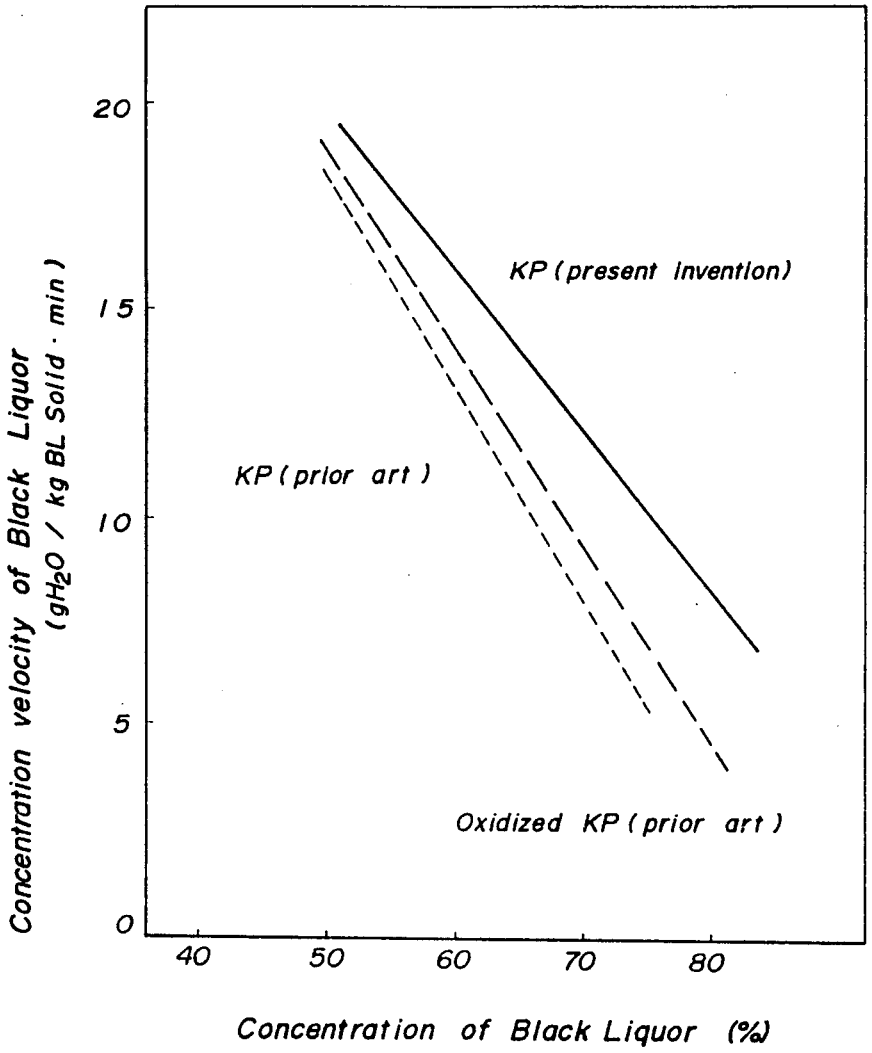
FIG. 6 is a graph illustrating the variations in the concentration velocity of the black liquor with the corresponding concentration thereof.

It is assumed that when the boiling point of the black liquor is reduced, its vapor pressure is increased accordingly. FIG. 6 shows the concentration velocity of the oxidized KP black liquor with added $CO_2$ gas. This confirms that the ability to be concentrated has been improved by the present invention.

The black liquor concentrated by the process of the present invention is less sticky than the black liquor concentrated by the prior process. The black liquor which is completely concentrated by the process of the present invention is very brittle and easily grindable and its capacity to absorb moisture is greatly reduced. This makes the preparation of a 100% solidified black liquor easier, and its combustion energy is effectively usable when it is burnt by a recovery boiler.

Concentrated soda-cooked black liquor also becomes less sticky by the addition of $CO_2$ gas, similarly, completely-concentrated soda-cooked black liquor is very brittle and easily grindable, and its capacity to absorb moisture is greatly reduced. Accordingly, solidified black liquor is also easily prepared by this method.

The highly-concentrated black liquor according to the present invention has a very low corrosivity with respect to the apparatus of the system. The reason therefor can be easily understood by experiments set forth below, conducted with respect to black liquor from which organic materials have been removed. When a test peace of stainless steel (SUS-304) which has a metallic luster surface is immersed in a boiled aqueous solution (solid content: about 50%; b.p.: 145° C.) of (1) a mixture of sodium hydroxide and sodium sulfide having a sulfidity of 25%, (2) a mixture of sodium hydroxide and sodium thiosulfate (i.e. a mixture obtained by oxidizing mixture (1)), the surface turns from liver brown to brown, and a dark green precipitate is formed. On the other hand, the metallic luster surface of the stainless steel was maintained unchanged in a boiled aqueous solution of a mixture of sodium carbonate and sodium thiosulfate, obtained by adding $CO_2$ gas to the mixture of (2) (concentration: from 50% to 100% (i.e. until it dried up); b.p.: 102° C.).

Presumably alkali corrosion occurred on the stainless steel (SUS-304) immersed in mixtures (1) and (2) because they are strongly alkaline and have a high boiling point. On the other hand, such corrosion is less likely to occur on the stainless steel immersed in the boiled aqueous solution of the mixture of sodium carbonate and sodium thiosulfate produced in accordance with the present invention, because it is less strongly alkaline and lower temperature than the above mixtures.

The moisture absorption properties of the black liquor concentrated by the method of the present invention is greatly reduced. This is probably because the mixture of sodium carbonate and sodium thiosulfate is less likely to absorb moisture from the air than mixture (1) which is deliquescent. Thus this method is very effective for keeping such a solidified black liquor in storage, and preventing moisture on combustion.

Turning to the second aspect of the applicants' invention, they have found that the viscosity of the AP black liquor can be lowered to the same level as or less than that of the KP black liquor by absorbing $CO_2$ gas contained in the AP exhaust gas into the AP black liquor and its ability to be concentrated is sharply improved.

The viscosity of the AP black liquor can be lowered to the same level as or less than that of the KP black liquor and the concentrating efficiency is largely improved by absorbing $CO_2$ gas containing in the AP exhaust gas into the AP black liquor.

Figure 26:
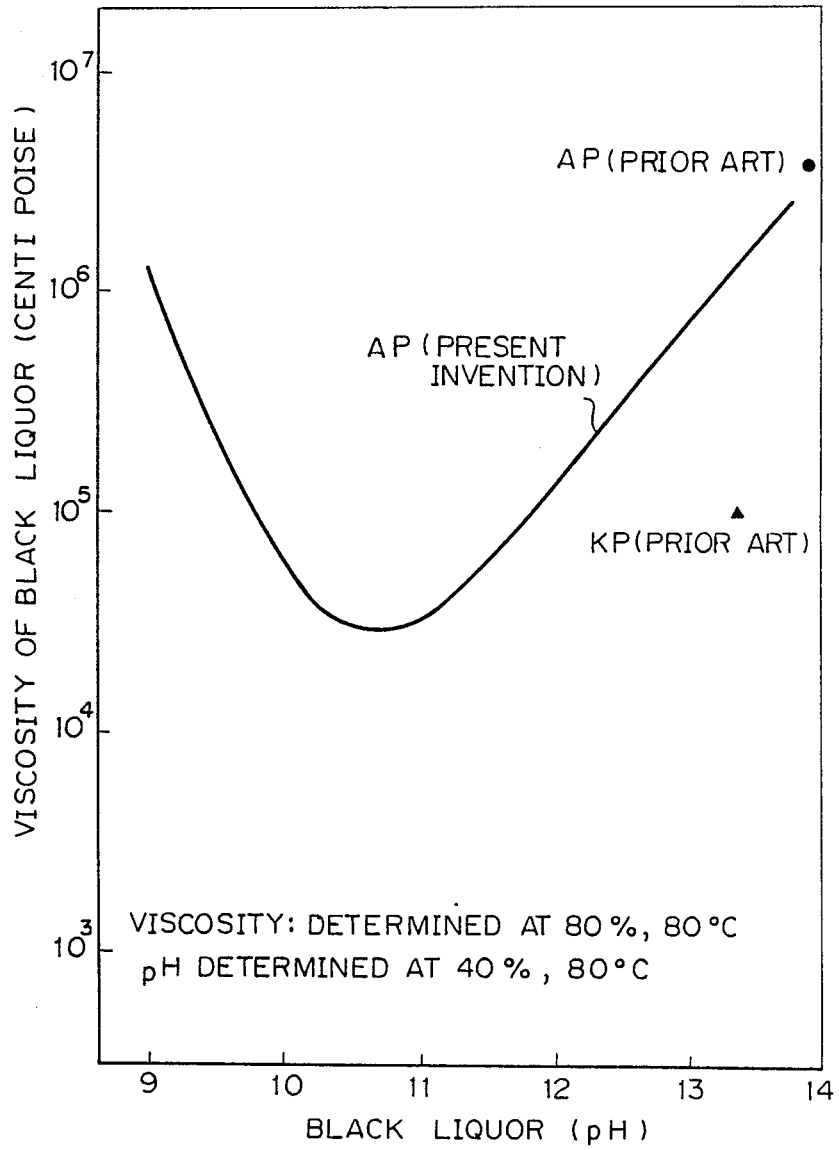
FIG. 26 shows the changes in the viscosity of the black liquor with the corresponding pH thereof.

The range of pH of the black liquor for which lowering of the viscosity can be expected is between 9.5 and 12.5, in which range a preferable result is obtained, or more preferably a pH in the range of 10.0 to 12.0 in which the black liquor concentration is 40% at 80° C. (pH values used hereinafter assume a black liquor concentration of 40% and a temperature of 80° C.). If the $CO_2$ gas contained in the AP black liquor is added to the black liquor only in such an amount that the pH of the black liquor remains in the range of 12.5 or more, the viscosity is not lowered sufficiently, as shown in FIG. 26. If the $CO_2$ gas contained in AP black liquor is added to the black liquor in an amount sufficient to cause the pH to be in the range of 9.5, it is presumed that the apparent viscosity of the black liquor is adversely increased due to the formation of solid substances in the black liquor.

Figure 27:
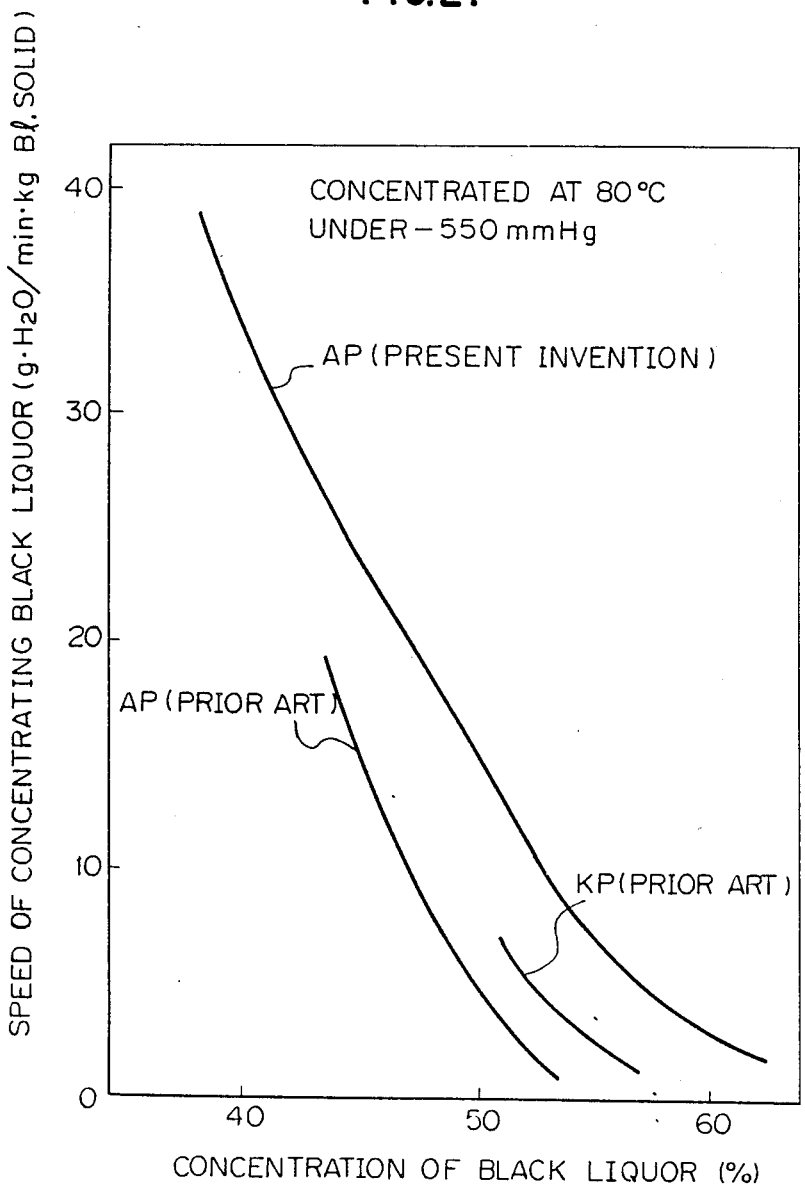
FIG. 27 shows the changes in the concentration speed of the black liquor with the corresponding concentration thereof.

The variation of the concentration speed in relation to the concentration of the black liquor concentration is shown in FIG. 27 which is directed to the property of the AP black liquor to be concentrated due to the absorption of the AP exhaust gas. As is apparent from FIG. 27, the ratio of the concentrating speed of the black liquor to which the $CO_2$ gas contained in AP exhaust gas according to the second aspect of the present invention has been added relative to that of the conventional untreated black liquor becomes larger as the concentration increases. As the concentration becomes high, the amount of the AP black liquor to be treated becomes small, but if the level is too high, it becomes impossible to absorb $CO_2$ gas contained in the AP exhaust gas due to the increase in viscosity. If the concentration is too low, the amount of the AP black liquor to be treated becomes large. The concentration of the black liquor at which $CO_2$ gas contained in the AP exhaust gas is added in the range of 40–65%.

Figure 28:
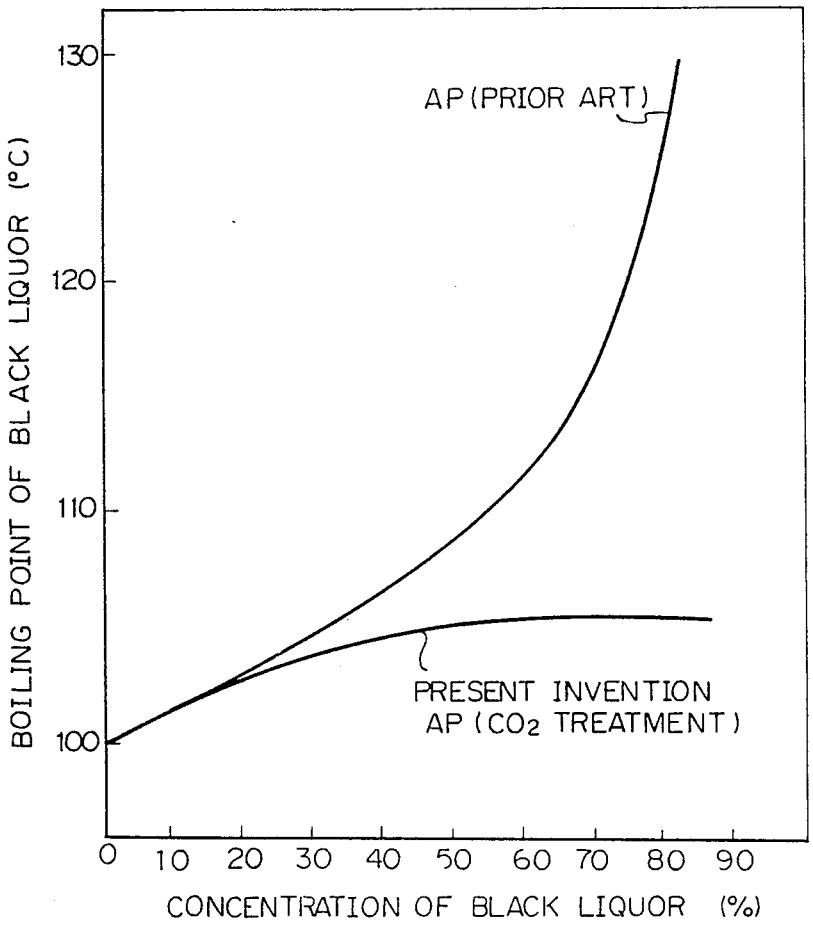
FIG. 28 shows the changes in the boiling point of the black liquor with the corresponding concentration thereof.
Figure 29:
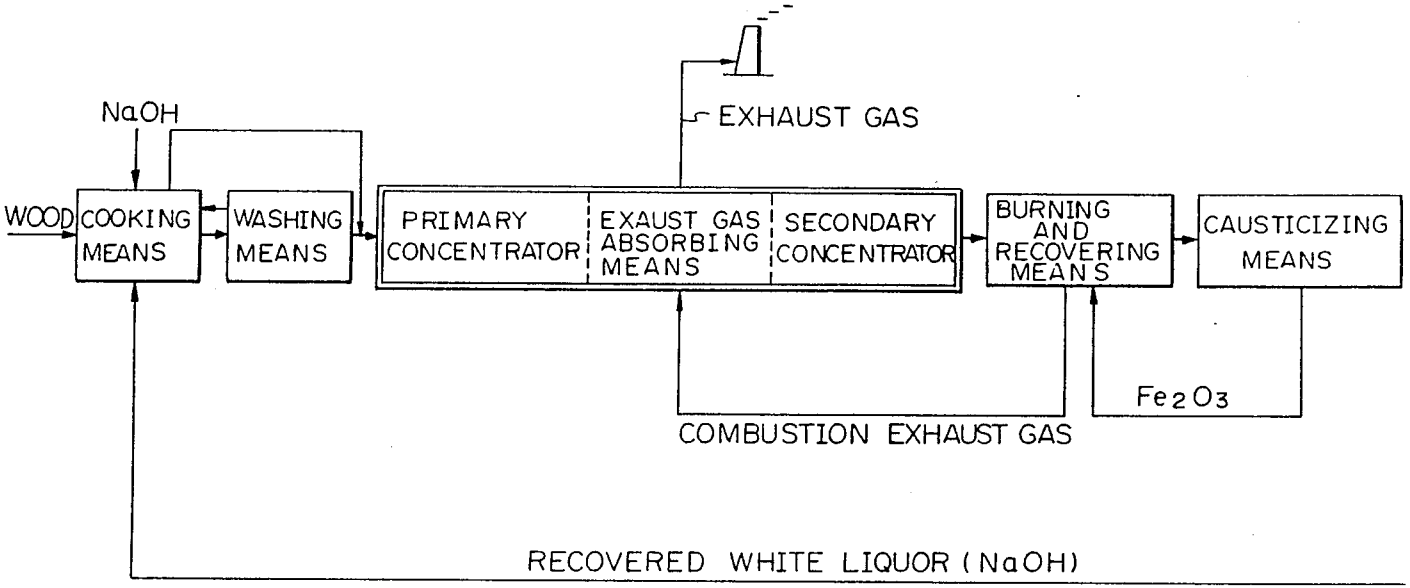
FIGS. 29 through 31 are flow sheets showing the working examples of the second aspect of the present invention.
Figure 30A:
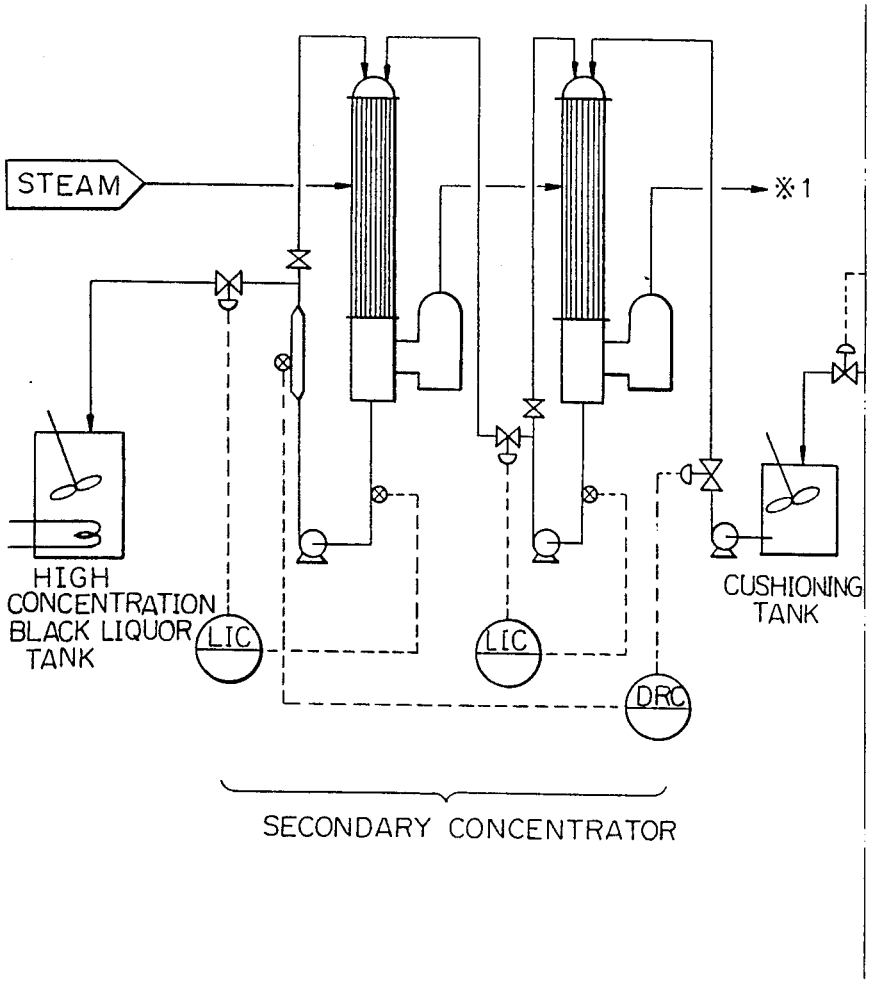
Figure 30B:
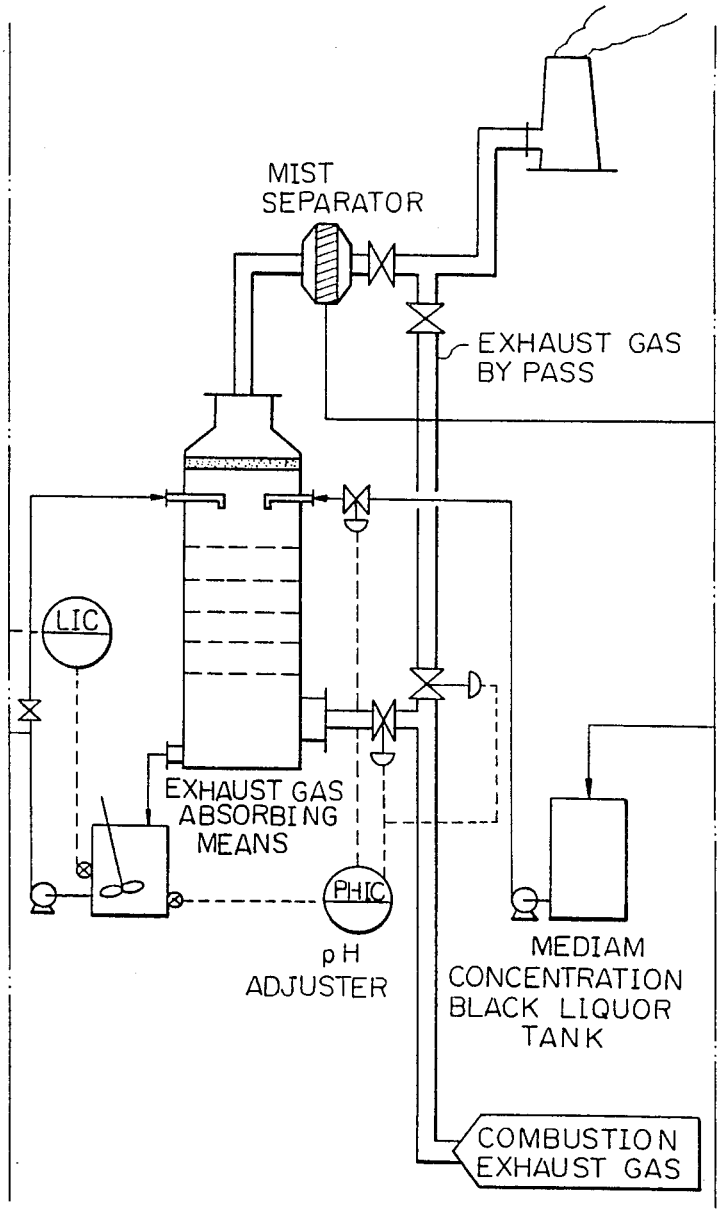
Figure 30C:
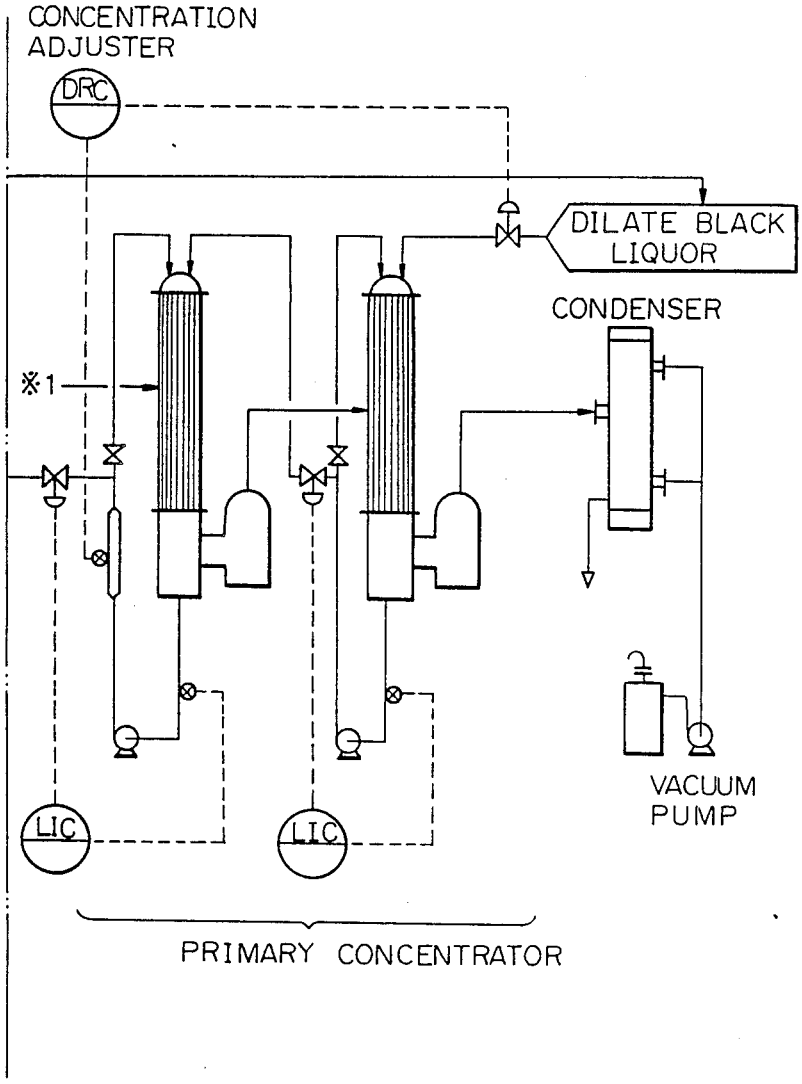

Applicants have discovered that the addition of $CO_2$ gas contained in the AP exhaust gas lowers not only the viscosity of the black liquor, but also the boiling point thereof. FIG. 28 shows the boiling points of the AP black liquor in which $CO_2$ gas contained in the AP exhaust gas has been absorbed as well as that of an untreated black liquor. The boiling point of the untreated AP black liquor rises with the increase in concentration of the black liquor and reaches 126° C. at a black liquor concentration of 80%. The boiling point of the AP black liquor to which $CO_2$ gas contained in the AP exhaust gas has been added gradually rises with the concentration of the black liquor up to 50% but it does not rise beyond 105° C. even if the concentration of the black liquor continues to rise.

A satisfactory explanation for this result is the fact that, assuming that the whole sodium content of the AP black liquor having a concentration of 80% is sodium hydroxide only, the boiling point of this black liquor is 118° C., while, assuming that the whole sodium content is sodium carbonate only, its boiling point is 105° C.

A decrease in the boiling point of the black liquor indicates that the vapor pressure of water at the same point is adversely high, so that the water in the black liquor is easily vaporized and the black liquor is easily concentrated.

It should also be understood that the purpose of the second aspect of the present invention, i.e., the feature of absorbing $CO_2$ gas into the AP black liquor, is not to separate lignin, silica and hemicellulose from the AP black liquor.

The following examples will aid in the disclosure of the applicants' invention, but should not be deemed as limiting the practice thereof.

EXAMPLE 1, COMPARATIVE EXAMPLES 1 AND 2, REFERENCE EXAMPLES 1, 2 AND 3

A black liquor having a pH of 10.50 (determined at a concentration of 40% and at 80° C.) was prepared by oxidizing in air at 80° C. a black liquor obtained by KP-cooking Douglas fir, and subsequently by bringing it into contact with $CO_2$ gas at 80° C. The boiling point of the black liquor was determined under atmospheric pressure. The boiling points of black liquor of the prior art which was not treated with $CO_2$ and oxidized black liquor were also determined. The results are shown in FIG. 1A. The boiling point at atmospheric pressure was determined for (1) a mixture of sodium hydride and sodium sulfide having a sulfidity of 25%, which is used in KP cooking, (2) a mixture of sodium hydroxide and sodium thiosulfate, which is obtained by oxidizing mixture (1), and (3) an aqueous solution of a mixture of sodium carbonate and sodium thiosulfate, which is obtained by adding $CO_2$ gas to mixture (2). The results are shown in FIG. 2.

EXAMPLE 2, COMPARATIVE EXAMPLE 3

Figure 3:
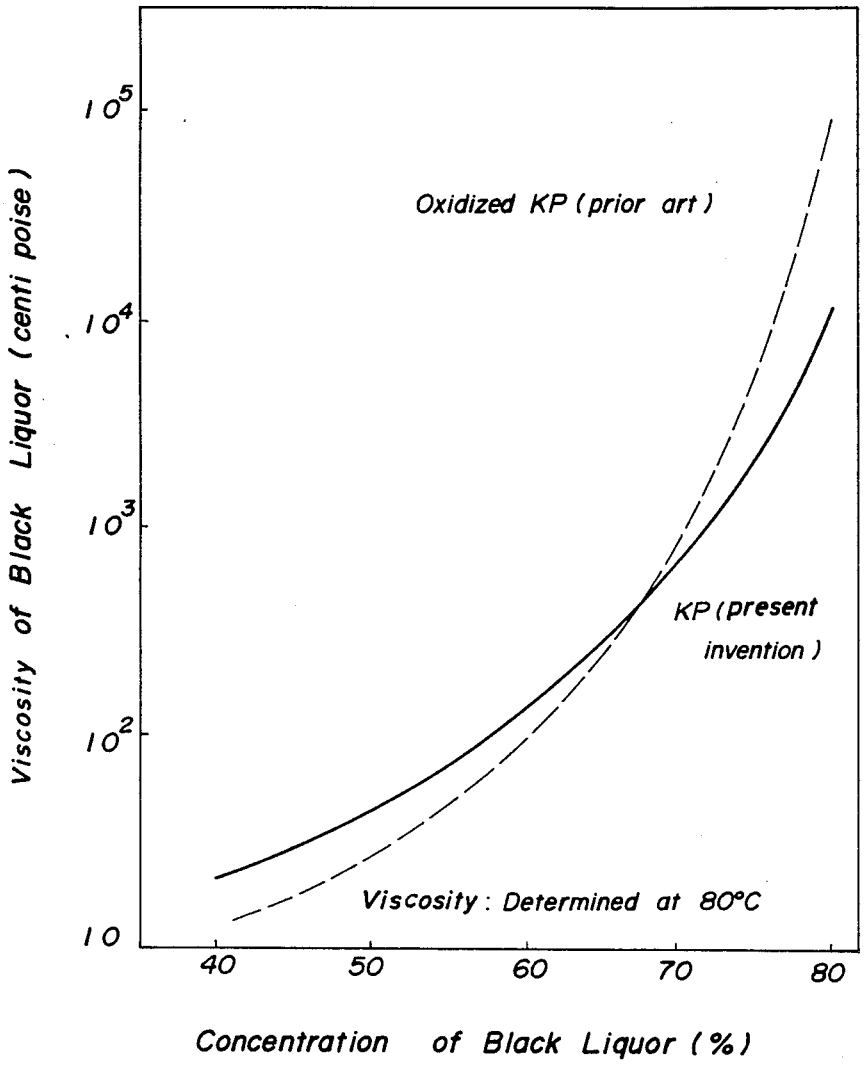
FIG. 3 is a graph illustrating the variations in the viscosity of the black liquor with the corresponding concentration thereof.

$CO_2$ gas was added to the oxidized KP black liquor used in Example 1, and its pH was adjusted to 10.50. FIG. 3 illustrates the variation in the viscosity of this liquor at 80° C. with respect to the corresponding concentration. Comparative Example 3 shows the results of the viscosity of the prior-art oxidized black liquor conducted by a similar procedure. The viscosity of the liquor was determined by a flow tester.

EXAMPLE 3

Figure 5:
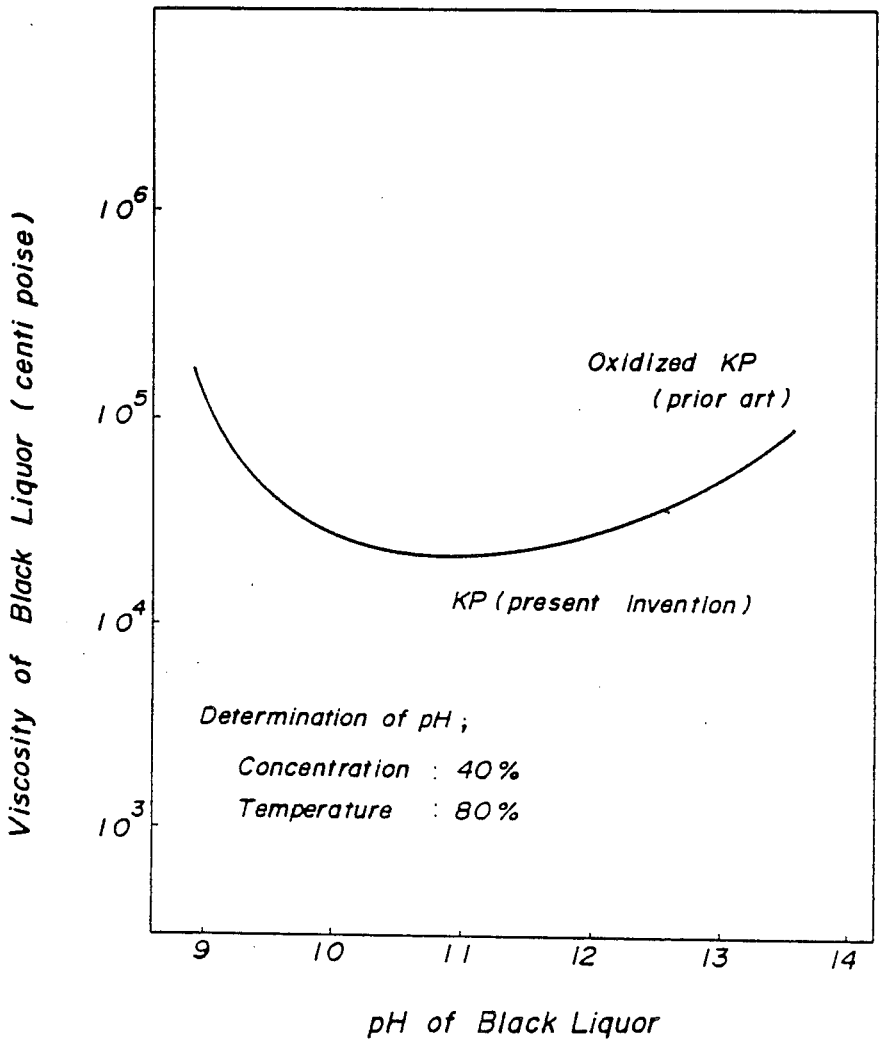
FIG. 5 is a graph illustrating the variations in the viscosity of the black liquor with the corresponding pH thereof.

$CO_2$ gas was added to the oxidized KP black liquor used in Example 1. The viscosity of the liquor was determined by varying the pH thereof (concentration: 80%, 80° C.). The results are shown in FIG. 5.

Table 1 shows examples of each of the pH, boiling point, and viscosity determined by the procedures of Examples 1 through 3. FIG. 4 illustrates the variations in the average diameter of the agglomerated particles with the corresponding pH thereof. The diameters were determined by a Coulter counter.

TABLE 1

| | Additive | pH 80° C., 40% | b.p. (°C.) 80%, 1 atm | Viscosity (CP) 80° C., 80% |
|---|---|---|---|---|
| Present invention | $CO_2$ | 12.5 | 108 | $3.4 \times 10^4$ |
| | $CO_2$ | 11.5 | 108 | $3.2 \times 10^4$ |
| | $CO_2$ | 11.0 | 108 | $2.4 \times 10^4$ |
| | $CO_2$ | 9.5 | 108 | $5.0 \times 10^4$ |
| | $CO_2$ | 9.0 | 108 | $8.0 \times 10^4$ |
| Prior art | $CO_2$ not added (non-oxidized) | 13.4 | 126 | $9.5 \times 10^4$ |
| | $CO_2$ not added (oxidized) | 13.4 | 121 | $9.5 \times 10^4$ |

EXAMPLE 4, COMPARATIVE EXAMPLES 4 AND 5

$CO_2$ gas was added to the oxidized black liquor used in Example 1, and its pH was adjusted to 10.50.

FIG. 6 illustrates the concentration velocity of this liquor, non-oxidized black liquor without added $CO_2$, and oxidized black liquor without added $CO_2$. The liquors of these three types were concentrated at −600 mmHg and 80° C. The rate was calculated from the reduced amount of water by weight.

The foregoing Examples relate to the introduction of $CO_2$ gas to oxidized KP black liquor and the contact-reaction therebetween, but the material introduced to the liquor is not limited to $CO_2$ gas. Exhaust gas containing $CO_2$ gas from the KP black liquor recovery boiler, or from burnt organic materials from another system, may be introduced into the black liquor, effectively causing a contact reaction therebetween.

One of the merits of the present invention is the use of combustion exhaust gas of a recovery boiler or of another system which is not otherwise useful. Thus, the present invention saves money by using such a source.

The $CO_2$ in the exhaust gas can also be used after it is concentrated by an absorption process or membrane separation process. In this case, the volume of a gas containing $CO_2$ gas introduced into the black liquor can be reduced, and the capacity of the black liquor to absorb $CO_2$ gas is increased.

The $CO_2$ gas-absorbing apparatus according to the present invention is set forth below in detail.

Figure 7:
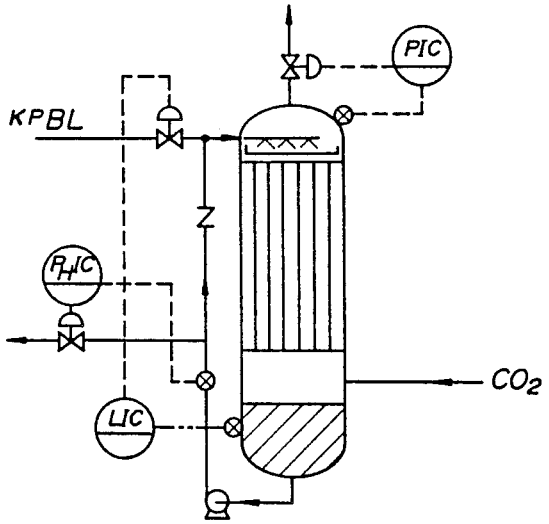
FIGS. 7 through 20 illustrate typical examples of the $CO_2$ gas-absorbing apparatus of apparatus of the present invention.
Figure 8:
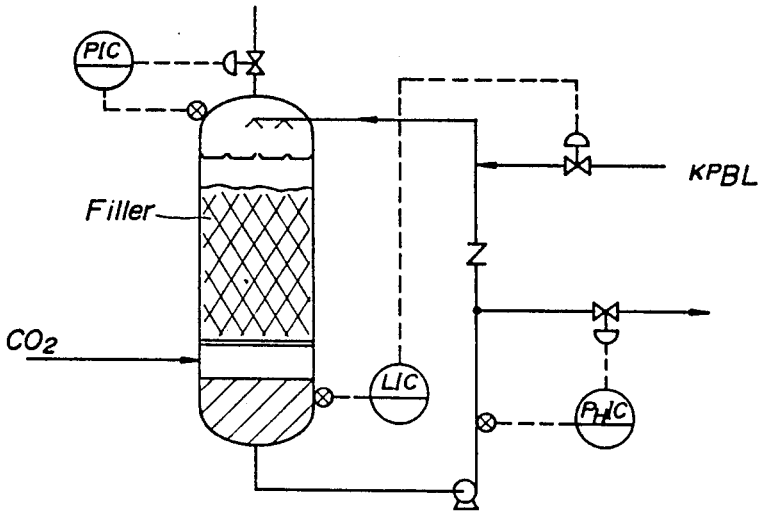
Figure 9:
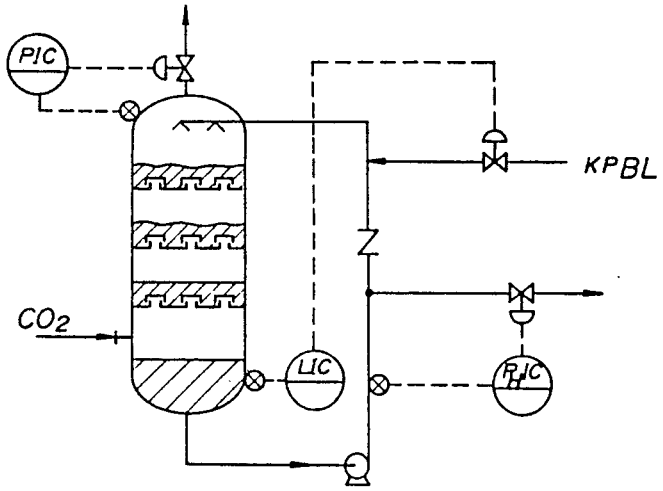
Figure 10:
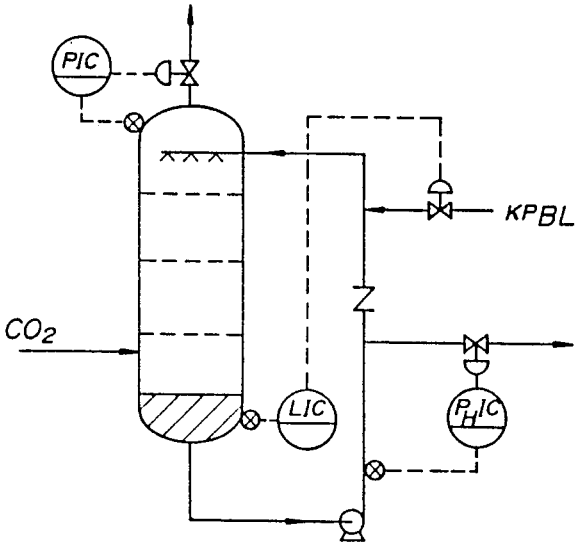
Figure 11:
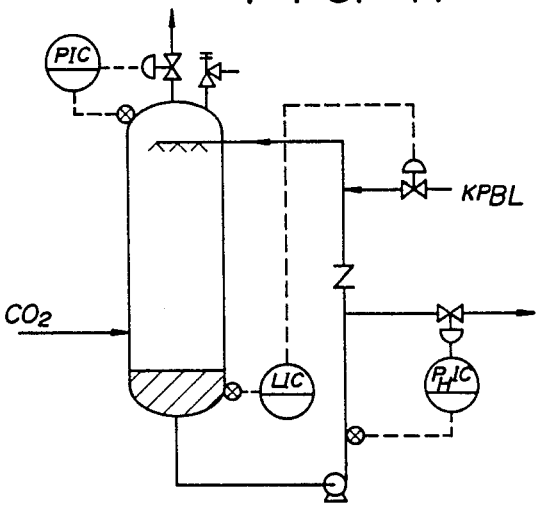
Figure 12:
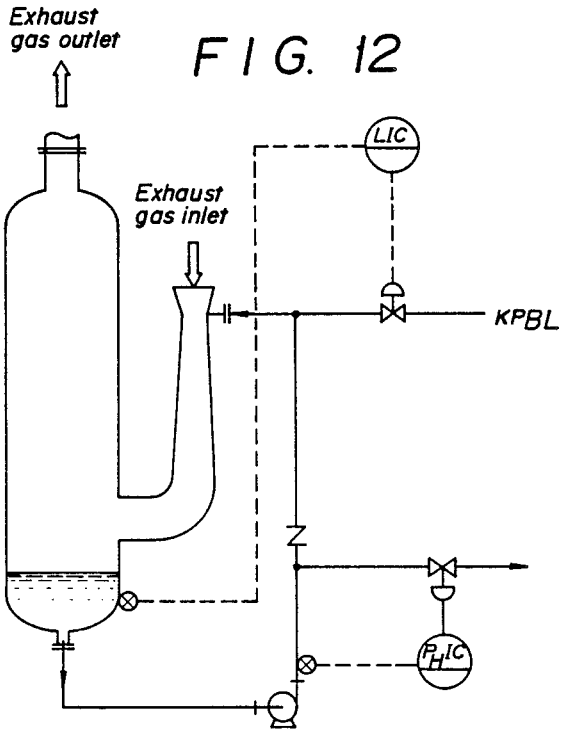
Figure 13:
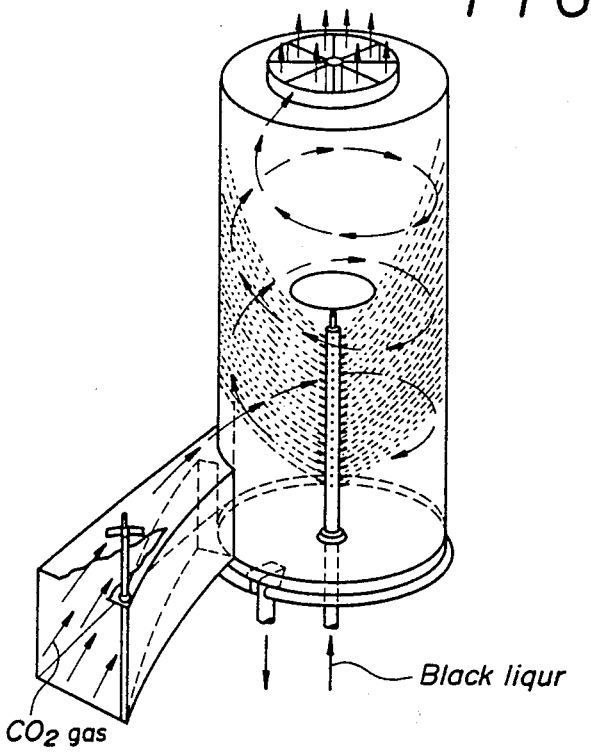
Figure 14A:
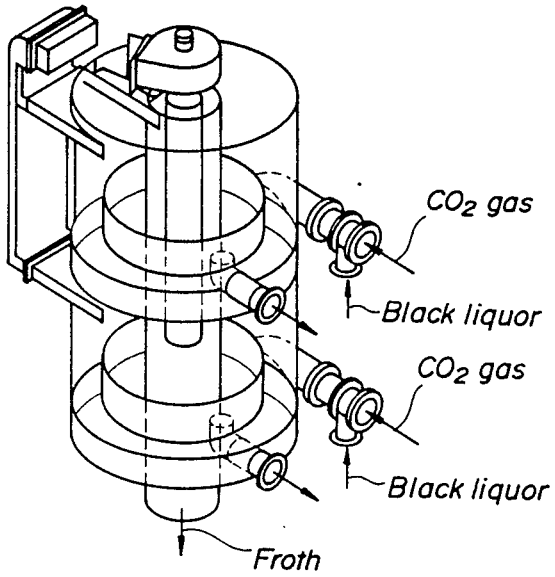
Figure 14B:
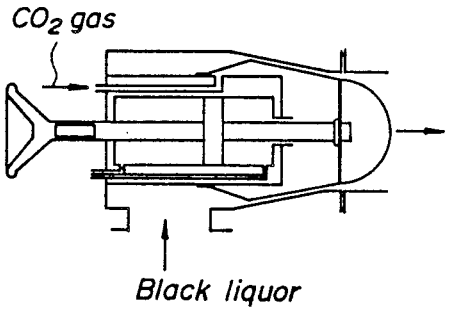

Vapor-liquid contacting apparatuses or gas-absorbing apparatuses of various types scan be used in the present invention, such as a known wetted-wall column (FIG. 7), a packed tower (FIG. 8), bubble-cap tower (FIG. 9), perforated-plate tower (FIG. 10), spray tower (FIG. 11), scrubber (FIG. 12), foam-mixing tank, cyclone-spray scrubber (FIG. 13), floatator used as a deinking apparatus in the pulp and paper industries, Swemack cell (FIG. 14), vertical floatator, or aeration apparatus for air or oxygen used in the activated sludge process. These apparatuses make it possible to have the oxidized KP black liquor absorb $CO_2$ gas by providing it with $CO_2$ gas and/or a gas containing $CO_2$.

Figure 15:
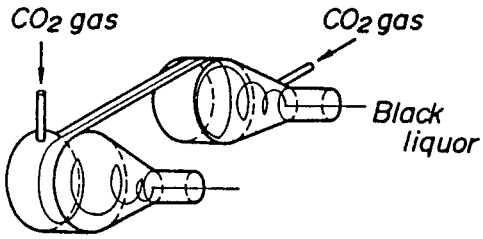

It is also possible to use a premixer (FIG. 15) as a gas-liquid contact apparatus for the present invention; this is generally used for chlorinating pulp in a medium concentration of chlorine. In this case, black liquor is introduced thereinto instead of a pulp slurry, and flue gas is introduced instead of chlorine and/or chlorine dioxide.

Figure 16:
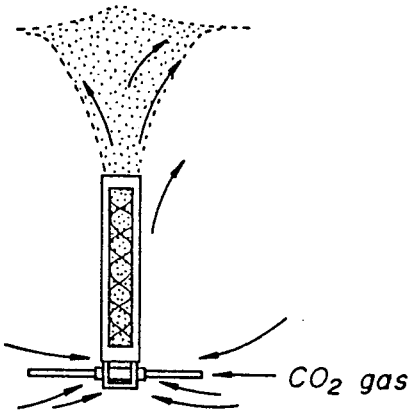
Figure 17:
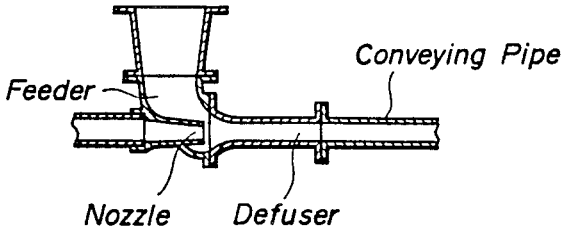
Figure 18A:
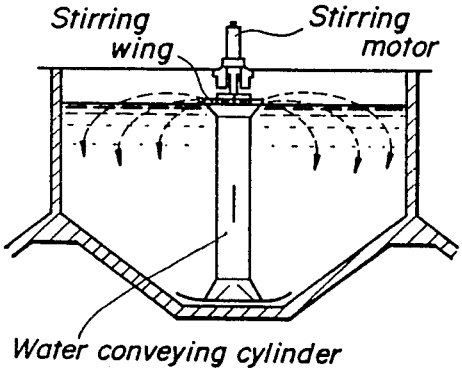
Figure 18:
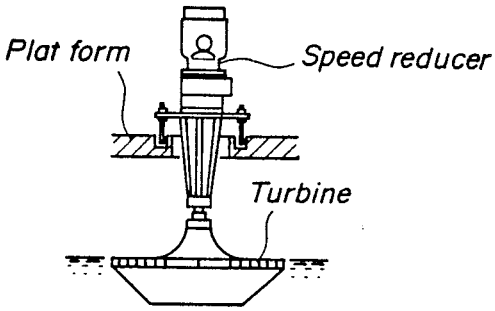

A static mixer (FIG. 16), injection feeder (FIG. 17), a steam ejector, or a mechanical stirring aeration apparatus (FIG. 18) using $CO_2$ gas and/or $CO_2$-containing gas are also usable as the gas-liquid contact apparatus for the present invention.

Figure 19A:
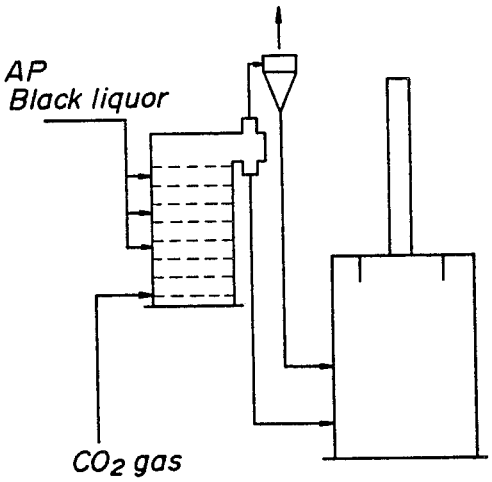
Figure 19B:
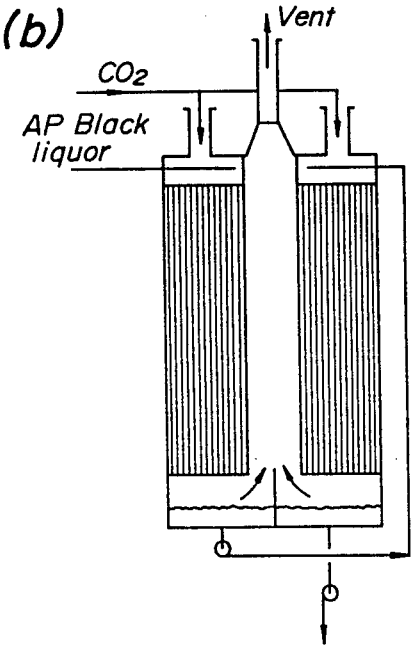

The foregoing various types of $CO_2$ gas-absorbing apparatus can be used alone or in combination. An oxidizing apparatus (FIG. 19 (*a*) or (*b*)) for black liquor can also be used as a $CO_2$ gas-absorbing apparatus for oxidized dilute black liquor, using $CO_2$ gas and/or $CO_2$-containing gas instead of air or oxygen for the oxidation.

It is also desirable to use an apparatus in which $CO_2$ gas and/or $CO_2$-containing gas is sucked into a mixing tank containing the oxidized black liquor, or in which the oxidized black liquor is sprayed into a tank containing $CO_2$ gas and/or $CO_2$-containing gas under at least atmospheric pressure.

When the combustion exhaust gas of the KP black liquor and the like is used as a gas source, foaming problems can be eliminated by the use of a wetted-wall tower of a multiple-tubular construction. It is also possible to control the gas-absorption performance by cooling the tube from the outside thereof, and such a $CO_2$ gas-absorption apparatus also has the merit that pressure losses on the gas side can be maintained at a comparatively low level. A packed tower, bubble cap tower, and/or perforated plate tower can also be used for the practice of the present invention, and it is desirable to provide a defoaming installation and a gas temperature-reducing installation which washes the exhaust gas with water.

It is further possible to use a Venturi scrubber, from the viewpoint of gas absorption performance, even although the pressure losses on the gas side are great, and it is difficult to control foaming. When such a $CO_2$-absorbing operation is conducted, it is conducted, it is sufficient to circulate the black liquor in the $CO_2$ gas-absorption apparatus with a pump, and draw it out while reducing its pH to 9.5–12.5, preferably 10.0–12.0, compared with the pH of the black liquor at the inlet.

A packed tower, perforated-plate tower or the like employing as a gas source the combustion exhaust gas of the KP black liquor are preferably usable as the $CO_2$ gas-absorption apparatus for KP black liquor of a relatively high concentration. In such towers, the gas-liquid contact is efficiently conducted. It is desirable to wash the exhaust gas with water beforehand and reduce its temperature to a lower level in order to avoid any problems that may be caused by the concentration of the black liquor, which concentration is conducted by adding the exhaust gas to the black liquor. On the other hand, when a wetted-wall tower is used for this purpose, its gas-absorption performance is greatly decreased by the increase of the liquid temperature. It is also preferable to use a Venturi scrubber, from the viewpoint of promoting the gas-liquid contact. In this case, the pressure losses on the gas side are large, but few problems are caused, even if the black liquor is concentrated by exhaust gas.

Figure 20:
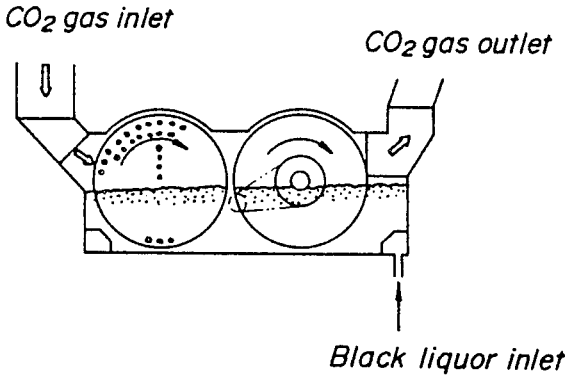
Figure 21:
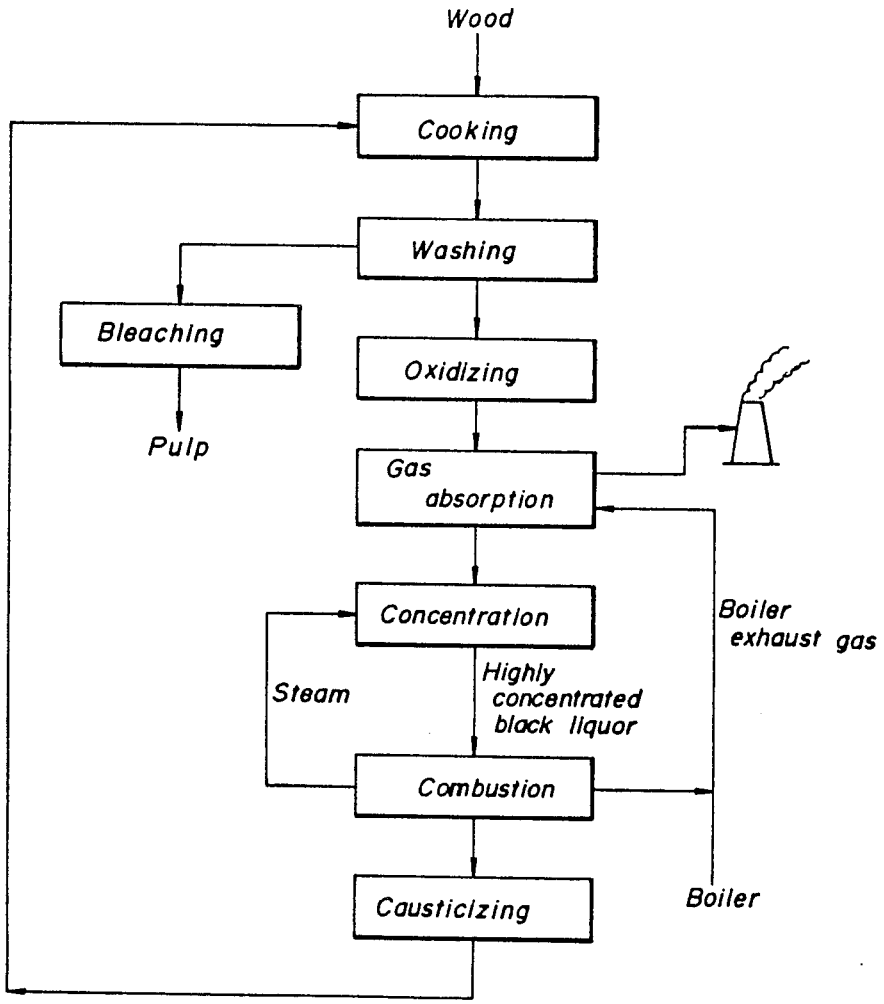
FIGS. 21 and 22 are flow charts of the present invention.
Figure 22:
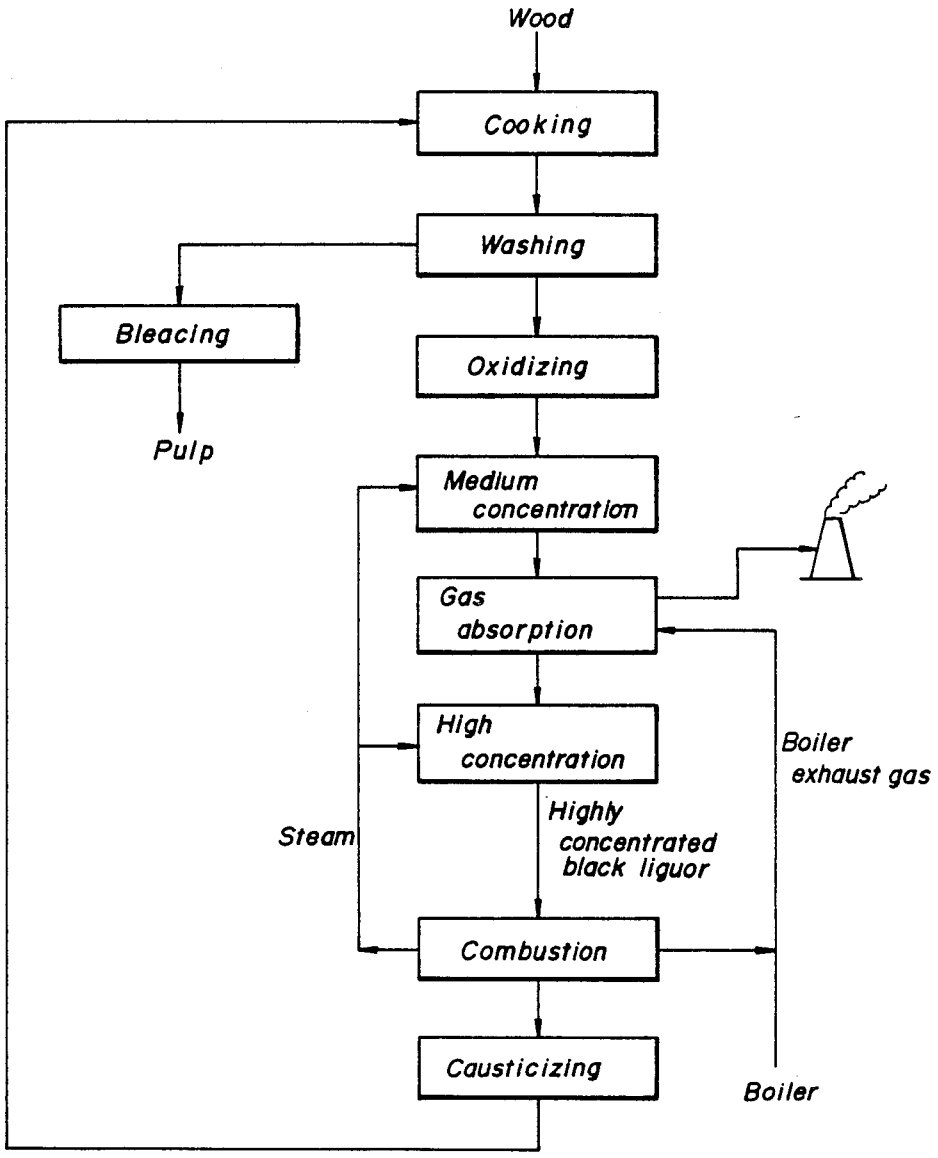
Figure 23:
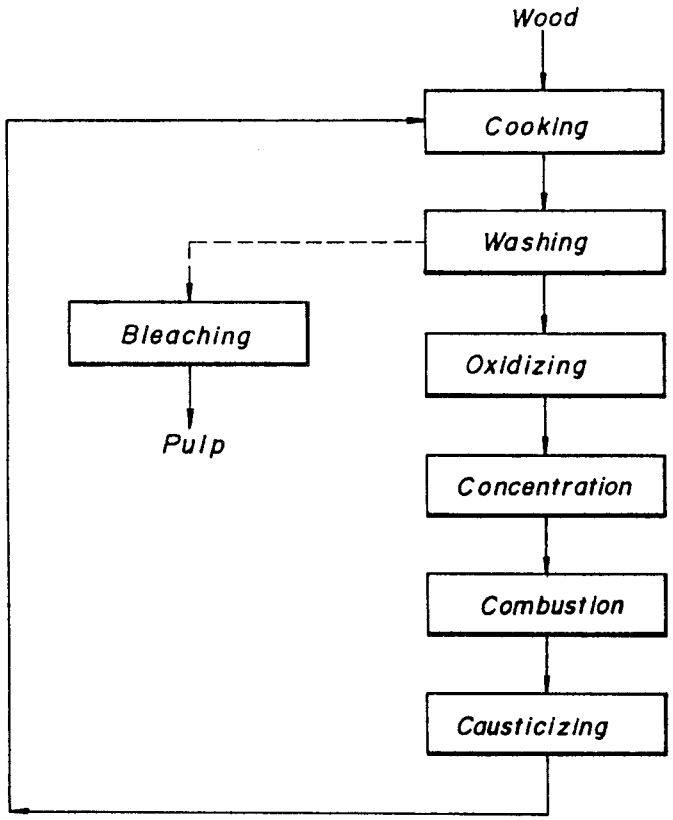
FIG. 23 PRIOR ART
FIG. 23 is a prior-art flow chart.
Figure 24:
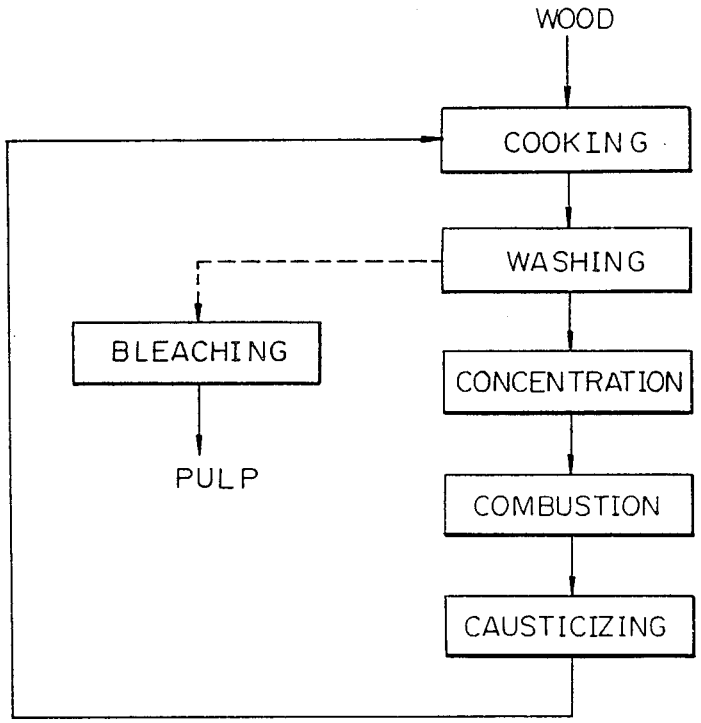
FIG. 24 PRIOR ART
FIG. 24 shows a flow sheet in the prior art.
Figure 25:
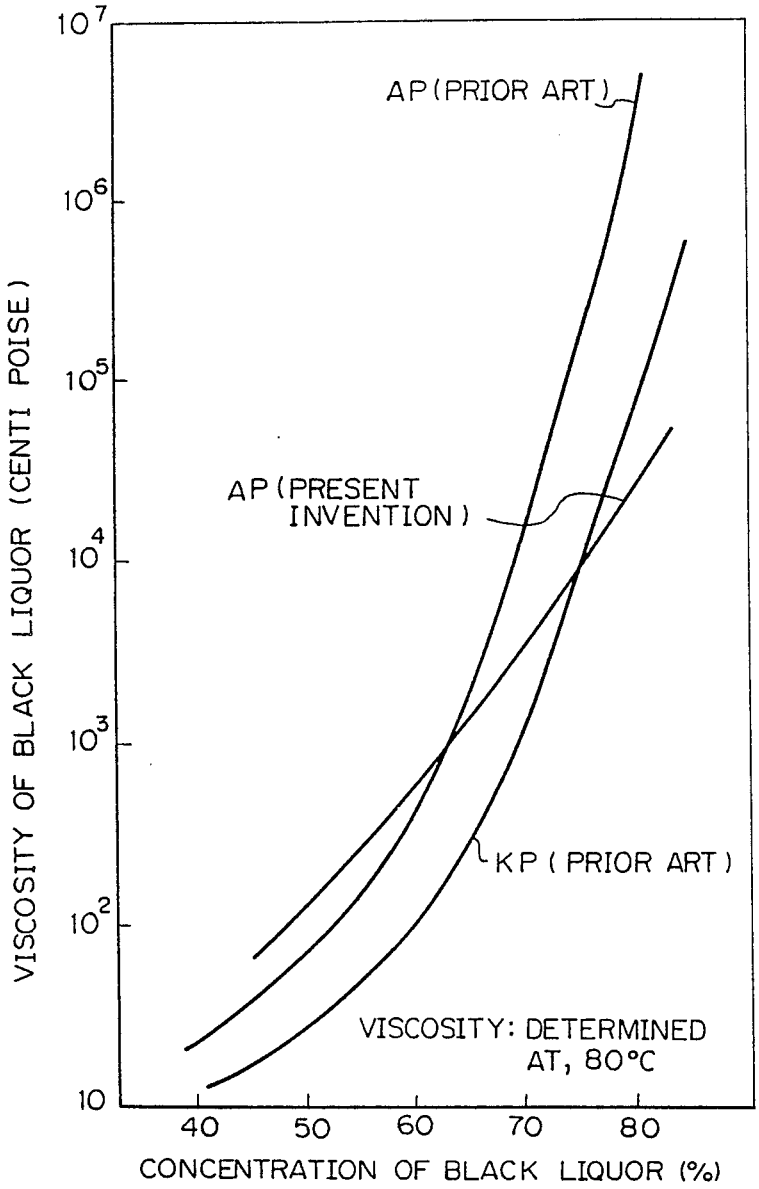
FIG. 25 shows the change in the viscosity of the black liquor with the corresponding concentration thereof.

Furthermore, it is possible to use a cascade evaporator (FIG. 20), which is conventionally employed in the art as a contact-reaction apparatus, in which black liquor of a medium concentration contacts the exhaust gas from a boiler. However, the $CO_2$ gas-absorption performance of this conventional apparatus is not recommended for use, because the apparatus of this type was designed only for the purpose of concentrating black liquor, and avoiding the contact-reaction of the $CO_2$ gas with the black liquor as much as possible. Thus, it is necessary to increase the speed of the drums and the number of the drums in order to bring the $CO_2$ gas in the exhaust gas into contact with the black liquor.

It is possible to use an apparatus which contacts a highly-concentrated black liquor with the exhaust gas of a boiler, in which the boiler exhaust gas in introduced from above and/or below the surface of the black liquor, in a black liquor tank of a disc evaporator conducting concentration by a rotary disc of an indirectly-heated type. In this apparatus, the degree of contact of the $CO_2$ gas with the black liquor, as well as the ability of the black liquor to be concentrated, can be promoted by providing a scraper near the surface of the rotary disc to scrape off the black liquor attached to the surface of the disc. It is also possible to use an apparatus which provides a gas-liquid contact between black liquor of a medium concentration and exhaust gas from a boiler, this apparatus is also applicable to liquor of a high concentration, or the use an apparatus having a pressure-resistant structure so that it can provide a gas-liquid contact at a high temperature. These gas-liquid contact apparatuses can be used alone or in combination, and may also be used as a black liquor concentration apparatus.

When $CO_2$ gas has been added to the oxidized KP black liquor, its boiling point is reduced by 1°–18° C. from that of black liquor which has not been treated with $CO_2$. The elevation of the boiling point of the black liquor can be maintained to within an extremely small range, so that it is possible to greatly enlarge the effective available temperature difference, compared with the total temperature difference in such a concentration apparatus. This not only realizes an improvement in the ability of the black liquor to be concentrated and a reduction in cost, but it also makes possible the concentration of the black liquor to a high level, and cause an increase in the quantity of heat recovered from the combustion of the black liquor.

According to the method of the present invention, since the viscosity of the liquor as well as the boiling point thereof is reduced, its fluidity is improved, and the motive power of the concentration apparatus is reduced. The ability of the liquor to be concentrated is also further improved.

Transport by pipe becomes easier owing to the improved fluidity, and this is expected to reduce the power load on the pumps transferring the black liquor through piping. If such a load is constant, it is assumed to be possible to transport black liquor of a higher concentration.

Moreover, owing to the improved fluidity i.e. the improved ability of the black liquor to be injected into a combustion furnace, it is expected to be possible to inject black liquor of a higher concentration. This indicates a decrease in the water content of the black liquor taken into the recovery furnace. The amount of water to be evaporated in the recovery furnace is thus reduced. The patent heat of evaporation is not totally used, and thus is considered to be available as effective heat energy.

EXAMPLE 5

As is shown in FIGS. 29 and 30A–C, the black liquor which is present intermediate between the primary and the secondary concentrators of the multi-effect AP black liquor concentrating means, that is, the black liquor having a concentration of 40–65%, is temporarily stored in a medium concentration black liquor tank provided on the downstream side of the primary concentrator. The black liquor stored in the tank is introduced into the absorbing means from the upper side thereof with pump. On the other hand, the AP black liquor combustion exhaust gas is introduced into the absorbing means from the lower side thereof so as to come into direct contact with the AP black liquor flowing down from the upper side through a perforated plate so that the $CO_2$ gas contained in the exhaust gas is absorbed into the AP black liquor. The AP black liquor having the $CO_2$ gas absorbing therein is discharged from the lower side of the absorbing means and introduced into a storage tank having a agitator for storage therein. A pH controlling means is disposed in the storage tank in such a manner as to contact the black liquor. The pH controlling means is adapted to control the amount of black liquor introduced into the absorbing means so that the pH of the black liquor is between 9.5 and 12.5, more preferably between 10.0 and 12.0. In addition, the black liquor in the storage tank is recirculated to the upper side of the absorbing means with a circulating pump so as to absorb the exhaust gas again until the pH of the black liquor in the storage tank reaches a predetermined range. The black liquor, which has reached a predetermined pH range is supplied in the same amount as that to be introduced in the absorbing means stored in a black liquor cushioning tank which supplies the black liquor to the secondary concentrator. This is controlled by the liquor level controlling means disposed on the storage tank. The black liquor stored in the cushioning tank is supplied to the secondary concentrator by a pump. On the other hand, the surplus exhaust gas which is discharged from the absorbing means is passed through a mist separator in order to remove mist therefrom, and is then discharged into the atmosphere from a smokestack. The mist thus separated is introduced into the primary concentrator as a dilute black liquor and concentrated therein. In this case, since the fairly highly concentrated black liquor was produced by concentrating a black liquor to some extent, the amount of the black liquor treated by the $CO_2$ gas contained in the AP exhaust gas is small, accordingly, the amount of power consumed by the gas-liquid contact is small, and the viscosity of the black liquor is not high enough to cause problems concerning the gas-liquid contact. The reaction of the $CO_2$ gas contained in the AP exhaust gas with black liquor ends within a relatively short time, and the black liquor is hardly foamed at all since the higher the concentration of the black liquor, the less its ability to be foamed.

EXAMPLE 6

Figure 31:
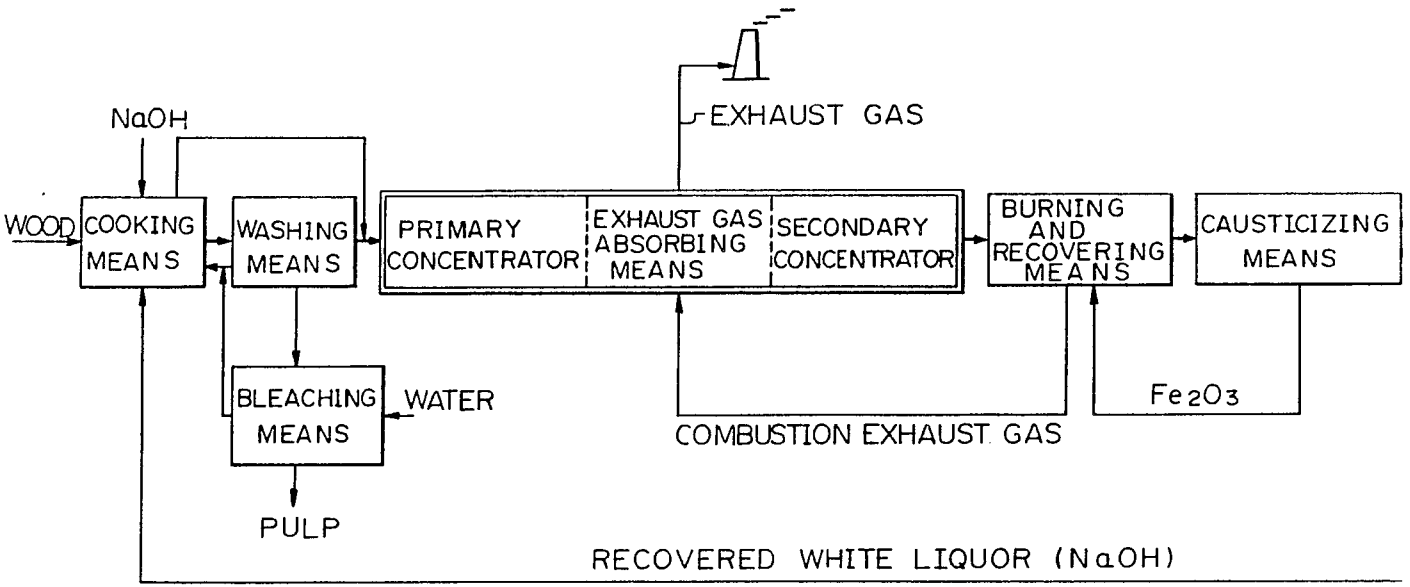

FIG. 31 shows a case where the black liquor which is to be introduced into the black liquor concentrating means is mixed with an alkaline waste liquor that is discharged from a bleaching means which follows a washing means and bleaches washed pulp with alkaline chemicals containing substantially no sulfur compounds.

In Example 6 also, treatment is carried out by various means similar to those of Example 5.

These examples are described by referring to the method of introducing the AP exhaust gas in the AP black liquor so as to react the $CO_2$ gas with the black liquor, but this is not intended to exclude a source of $CO_2$ gas other than this AP exhaust gas, as it is also possible to use in place of the AP exhaust gas the combustion gas of the boiler or a tail gas from a different process which contains $CO_2$ in an amount of more than 10% by volume.

It is advantageous to use such a tail gas because it is very cheap as a source of gas. The $CO_2$ gas contained in the boiler exhaust gas and the tail gas can be used after concentrating it through the absorption process, the membrane separation process or the like. The efficiency of absorbing gas is improved by these processes.

The absorbing means according to the present invention is set forth in detail.

Figure 32:
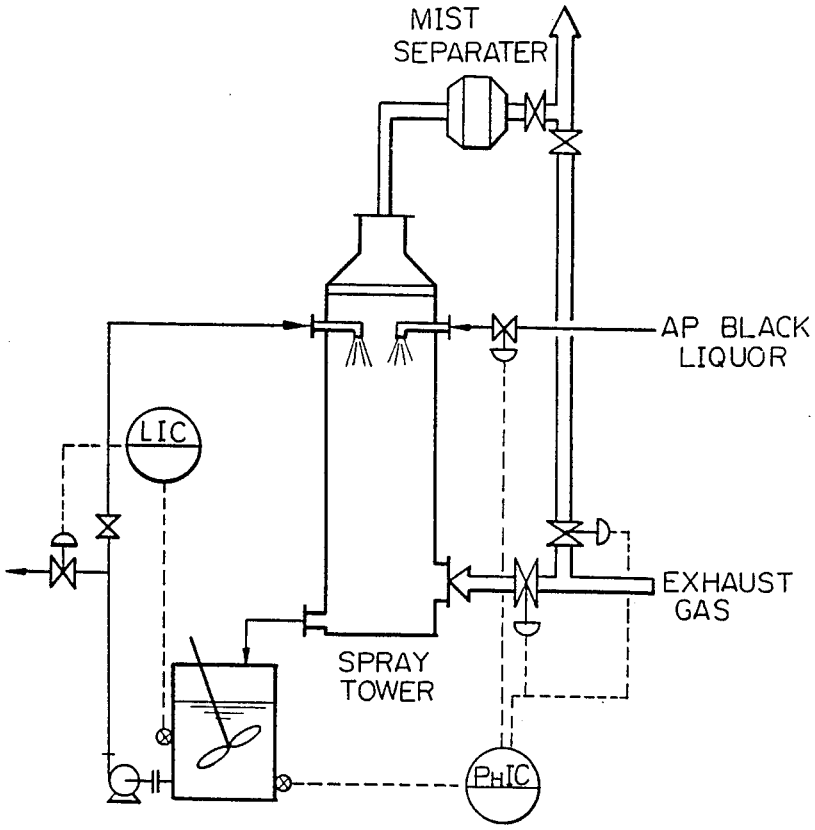
FIGS. 32 and 33 show a spray tower and a Venturi scrubber, respectively and they are typical examples of $CO_2$ gas absorbing means used in the present invention.
Figure 33:
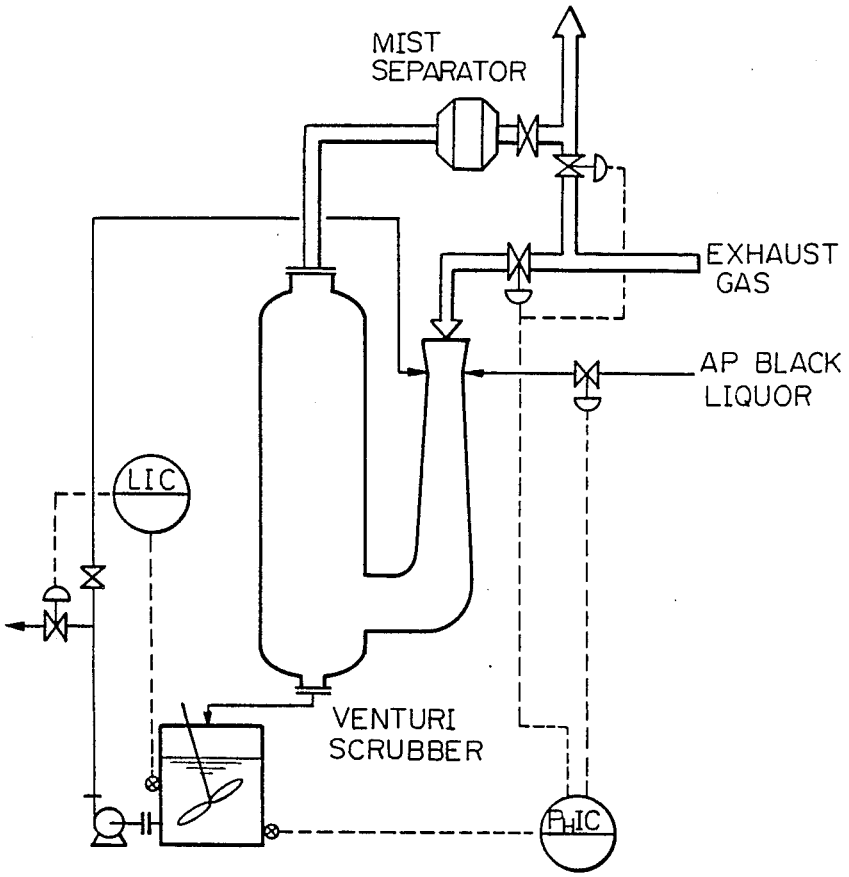

The exhaust gas absorbing means of various types can be used in the present invention, such as a perforated-plate tower (FIG. 30A–C), spray tower (FIG. 32), and Venturi scrubber (FIG. 33).

In considering the efficiency of gas absorption and pressure drop, a Venturi scrubber is preferably used, more preferably a spray tower and most preferably a perforated plate tower in these exhaust gas absorbing means.

Figure 34:
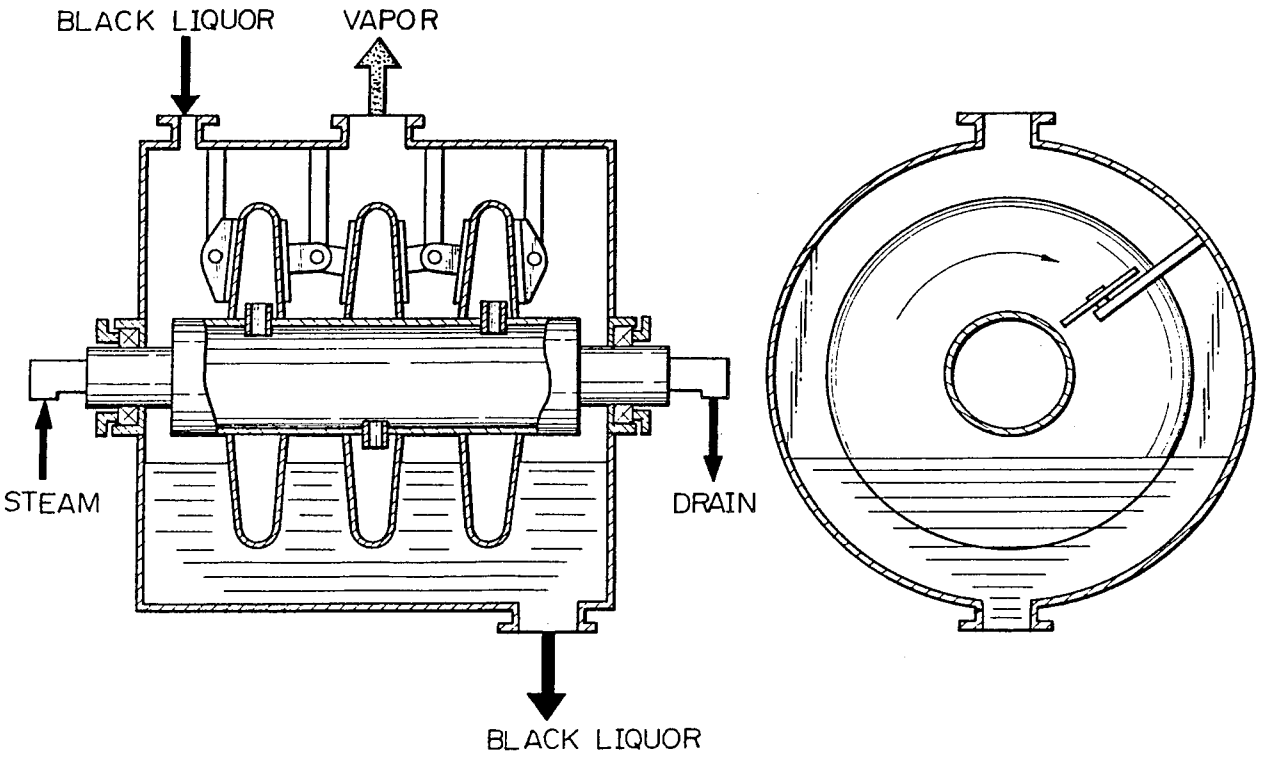
FIG. 34 shows a disk evaporator which may be used as a part of the secondary concentrator.

As the concentrating means, a falling-film type multieffect evaporator is employed in Examples 5 and 6, it is particularly advantageous to employ a disk evaporator (see FIG. 34) as a part of the secondary concentrator for a high solid concentration.

As discussed above, the viscosity of the AP black liquor can be greatly reduced by providing the AP exhaust gas absorbing means absorbing $CO_2$ into the AP black liquor. As a result, the performance of the concentrating apparatus is sharply increased.

The elevation of the boiling point of the black liquor can be maintained to within an extremely small range, so that it is possible to greatly increase the temperature difference. This not only results in an improvement in the property of the black liquor to be concentrated, the miniaturization of the concentrating apparatus and a reduction in cost, but it also makes possible the concentration of the black liquor to a high consistency, and causes an increase in the quantity of heat recovered from the combustion of the highly concentrated AP black liquor.

The provision of a storage tank having a liquid level controlling means and a pH controlling means makes it possible to constantly and continuously supply the black liquor to the secondary concentrator.

What is claimed is:

1. A method of concentrating an alkaline waste liquor in order to recover cooking chemicals from said waste liquor, said method consisting essentially of the steps of, (1) oxidizing an alkaline waste liquor containing sulfur compounds which is discharged from a step of Kraft-cooking wood material, and (2) concentrating said waste liquor by an indirect heat-concentration process, wherein a gas containing $CO_2$ derived from an exhaust gas of a combustion process is added after step (1), and wherein said gas is added prior to step (2) or between two or more stages during step (2), and controlling the pH of said waste liquor by the $CO_2$ addition to be within the range of 9.5 to 12.5 in order to lower the boiling point and viscosity of said waste liquor and to promote the solidification thereof.

2. A method according to claim 1, wherein the source of said $CO_2$-containing gas is selected solely or in combination from an exhaust gas from a recovery boiler burning said concentrated waste liquor, a boiler burning materials containing organic compound other than said waste liquor, a combustion furnace, an incinerator, or a reaction furnace.

3. A method according to claim 1, wherein the $CO_2$ gas in said exhaust gas is concentrated prior to said gas being added to the waste liquor.

* * * * *